US005658140A

United States Patent [19]

Kondou et al.

[11] Patent Number: 5,658,140

[45] Date of Patent: Aug. 19, 1997

[54] COMBUSTION DEVICE

[75] Inventors: Masato Kondou; Naoto Tominaga; Kikuo Okamoto; Toru Izumisawa; Kazuyuki Iizumi; Takehisa Majima, all of Yamato, Japan

[73] Assignee: Gastar Co., Ltd., Yamato, Japan

[21] Appl. No.: 590,282

[22] Filed: Jan. 23, 1996

[30] Foreign Application Priority Data

| | | | |
|---|---|---|---|
| Jan. 30, 1995 | [JP] | Japan | 7-033095 |
| Jan. 31, 1995 | [JP] | Japan | 7-036284 |
| Apr. 21, 1995 | [JP] | Japan | 7-120715 |
| Apr. 28, 1995 | [JP] | Japan | 7-129832 |

[51] Int. Cl.[6] ..... F23N 5/00

[52] U.S. Cl. ..... 431/90; 431/89; 431/31; 431/78

[58] Field of Search ..... 431/19, 30, 31, 431/78, 80, 90, 89, 18

[56] References Cited

U.S. PATENT DOCUMENTS

| | | | |
|---|---|---|---|
| 4,436,506 | 3/1984 | Berkhof . | |
| 4,752,210 | 6/1988 | Trent | 431/31 |
| 4,913,128 | 4/1990 | Adachi | 431/89 |
| 4,927,351 | 5/1990 | Hagar et al. | 431/90 |
| 5,222,888 | 6/1993 | Jones et al. | 431/18 |
| 5,520,533 | 5/1996 | Vrolijk | 431/90 |

FOREIGN PATENT DOCUMENTS

| | | |
|---|---|---|
| 13114954 | 11/1982 | Germany . |
| 4334625 | 4/1994 | Germany . |
| 17466 | 1/1991 | Japan . |
| 5-118532 | 5/1993 | Japan . |
| 5-118538 | 5/1993 | Japan . |
| 5-157228 | 6/1993 | Japan . |
| 5-161208 | 6/1993 | Japan . |
| WO96/07056 | 3/1996 | Japan . |
| 2271443 | 4/1993 | United Kingdom . |

*Primary Examiner*—Carroll B. Dority
*Attorney, Agent, or Firm*—Greer, Burns & Crain, Ltd.

[57] ABSTRACT

A combustion of the present invention has a burner, a combustion fan supplying air to the burner, revolution rate detection means for detecting a revolution rate of the fan, and an air-flow rate sensor for detecting an air-flow rate of the air. The combustion device further has a temperature sensor for detecting a temperature at the combustion device and diagnosis means for performing a self-diagnosis to determine a ventilation condition based on a relationship between the revolution rate and the air-flow rate. The diagnostic means correct the detected revolution rate or the air-flow rate based on the temperature of the combustion device in the process of performing the self-diagnosis. The diagnosis means perform the self-diagnosis after a predetermined time has passed until there is no temperature variance in the combustion device since a combustion halts.

26 Claims, 19 Drawing Sheets

FAN REVOLUTION RATE CALCULATION EXPRESSION: WHEN NON-COMBUSTION AND APPROPRIATE $$R=5T+1930\ (rpm) \text{---(EXPRESSION 1)}$$

FAN REVOLUTION RATE CALCULATION EXPRESSION: FOR DETERMINATION OF THE LIFETIME $$R=5T+(1930+R1)\ (rpm) \text{---(EXPRESSION 2)}$$

R1: INCREASE IN REVOLUTION RATE

START
101
PASSED 4 HOURS ?
NO
YES
102
DRIVE FAN
(ABOUT 10 SEC.)
103
DIAGNOSIS TIMES + 1
DIAGNOSIS DATA
104
1700~2700 rpm ?
NO
YES
116
ABNORMALITY TIMES + 1
TIMES<5
NO
117
YES
118
'38' ERROR
105
TIMES≧32
NO
YES
106
DATA PROCESS
119
INITIAL VALUE SET
107
INITIAL VALUE ?
NO
YES
108
ALARM ?
NO
YES
109
DATA> 2500 rpm ?
NO
YES
115
CLEAR COUNT
110
COUNT + 1
111
COUNT≧3
NO
YES
115(2)
DISPLAY COUNT
112
"10" MODE
113
DATA> 2600 rpm ?
NO
YES
114
'99' ERROR

COMBUSTION DEVICE

BACKGROUND OF THE INVENTION

1. Field of the Invention

The present invention relates to a combustion device, such as a water heater or a bath water heater, and in particular to a combustion device that while taking a temperature characteristic into account can detect a ventilation abnormality that is due to the blockage of a heat exchanger.

2. Related Arts

A combustion device, such as a water heater, supplies hot water on demand under the control of a controller that incorporates a sequential program for controlling a supply of hot water. In each instance, the controller calculates a calorific value to be supplied time after time in order to increase to a preset temperature the temperature of water that enters into a water heater. The supply of gas is adjusted in accordance with the combustion capability of gas having the demanded calorific value. In addition, the revolution rate of a combustion fan is controlled to supply an air-flow rate in accordance with the combustion capability. In this manner, an air-flow rate that is optimal for the combustion of gas is supplied to a burner, with the result that an air/gas ratio can be accurately controlled and complete combustion achieved.

The control of the air-flow rate is performed by using an air-flow rate sensor. The output data provided by the air-flow rate sensor are employed to acquire a difference between a required air-flow rate and an air-flow rate that is actually detected by the air-flow rate sensor. The revolution rate of the combustion fan is adjusted to correct for the acquired difference, and an optimal air-flow rate that matches the combustion value is supplied.

Commonly, when a water heater is used for an extended time period, fins in the heat exchanger of a water heater become blocked with dust, etc. As such blocking is a gradual and progressive process, resistance to the flow of ventilating air is gradually increased, accordingly. Finally, the air-flow rate required for the combustion of a burner can not be acquired even through the combustion fan is revolved at its maximum ability, and the end of the useful life of the water heater is reached. In other words, the end of the useful life has been reached means, in this case, that an abnormality has occurred in the combustion device and that the device should be either repaired, or discarded.

The present applicant proposed, in another patent application (International Patent Application No. PCT/JP95/01720 filed on Aug. 30, 1995), that the life of a water heater be determined based on a characteristic between the output of an air-flow rate sensor and the revolution rate of a combustion fan that is employed.

However, in case that the life of the combustion device is to be determined by self diagnosis when a burner is in the non-combustion state, the relationship between the air-flow rate, which is detected by the air-flow rate sensor, and the revolution rate of the combustion fan, which performs air-intake and flue ventilation, is affected by a change in the temperature of the ambient air or within the combustion device. That is, the revolution rate of the fan is linearly changed with respect to changes in the output data of the sensor; however, when the temperature (also called system temperature or ambient temperature) is changed while the data output by the sensor output are constant, the fan revolution rate is varied, even through the sensor output is constant. For example, when the ambient air temperature is raised from 0° C. to 30° C. while the data output by the sensor output are constant, the fan revolution rate is shifted (increased) by about 450 rpm, even though the sensor output is constant. This influence due to temperature is also apparent in the data output by the air-flow rate sensor when the fan revolution rate is constant.

As is described above, when the useful life of a water heater is determined during non-combustion, the characteristic relationship between the revolution rate of the combustion fan and the output by the air-flow rate sensor is varied due to change in the ambient air temperature or changes in the internal temperature of the device. Therefore, the useful life (or the existence of an abnormality) for the water heater can not be accurately determined.

Second, while the blocking of the heat exchanger by dust progresses gradually and occurs over a period of several months, the deterioration of the output characteristic of the sensor, like the air-flow rate sensor, etc., is commonly progressive over a period of a year. The final deterioration of the sensor output characteristic, however, may occur momentarily during an earthquake or upon the impact of an object, and thus the momentary deterioration of the sensor output characteristic must be detected in advance. This must be done because adequate combustion control and the above described determination of the useful life or of the existence of an abnormality can be performed by using correct sensor output data.

The deterioration of the output data characteristic of the air-flow rate sensor is also detected by first setting the revolution rate of the combustion fan to a predetermined value, and then checking the sensor output data at that time; or by first controlling the fan revolution rate in order to set the output data of the air-flow rate sensor to a predetermined value, and then checking the fan revolution rate at that time. In this case, also, there is the influence due to temperature changes.

Third, the influence due to temperature changes must be considered in order to detect a dust blockage or a deterioration of the sensor output data characteristic by referring to the relationship of the revolution rate of the combustion fan and the air flow rate. It is therefore desirable that the state of the ventilation be examined when there is no combustion. However, as there is a variation in the temperature in the interior of the combustion device right after the combustion is terminated, an adequate examination is difficult.

Fourth, during the examination of the characteristic in the non-combustion state, a user may sometimes use the combustion device, and the characteristic examination may inconvenience the user.

SUMMARY OF THE INVENTION

It is, therefore, one object of the present invention to provide a combustion device that can appropriately diagnose the ventilation condition in the combustion device.

It is another object of the present invention to provide a combustion device that can circumvent the influence of the internal temperature in the device or the ambient air temperature when the combustion device performs a self-diagnosis to determine its ventilation condition.

It is an additional object of the present invention to provide a combustion device that can correct the revolution rate of a combustion fan or the air-flow rate in accordance with the internal temperature of a device or the ambient air temperature when the combustion device performs a self-diagnosis to determine its ventilation condition.

It is a further object of the present invention to provide a combustion device that can perform self-diagnosis to determine the ventilation condition in a state of no combustion after a variance in temperature in the device has disappeared several hours after the halting of combustion.

It is a still further object of the present invention to perform a self-diagnosis to determine the ventilation condition when a down draft of ambient air and the influence due to a failure of an air-flow rate sensor are removed.

It is a still another object of the present invention to prevent the performance of a self-diagnosis to determine the ventilation state from interfering with the normal employment of a combustion device.

To achieve the above objects, according to the present invention, a combustion device comprises:

a burner;

fuel supply means for supplying fuel to the burner;

a combustion fan supplying air for combustion to the burner;

revolution rate detection means for detecting a revolution rate of the combustion fan;

an air-flow rate sensor for detecting a flow rate for air to be supplied to the burner;

combustion control means for controlling fuel supplied by the fuel supplying means and the revolution rate of the combustion fan so as to adjust a combustion at the burner;

a temperature sensor for detecting a temperature at the combustion device; and diagnostic means for performing, while there is no combustion, a self-diagnosis to determine a ventilation condition based on a relationship between the revolution rate of the combustion fan detected by the revolution rate detection means and an air-flow rate detected by the air-flow rate sensor, said diagnostic means correcting the detected revolution rate and the air-flow rate based on a temperature detected by the temperature sensor in the process of performing the self-diagnosis.

And further, the diagnosis means performs the self-diagnosis after a predetermined time period has passed following the halting of combustion. The predetermined time period is several hours for example.

Further, the diagnostic means stores as for the ventilation condition a first permissible range that corresponds to a first blockage rate, and a second permissible range that corresponds to a second blockage rate which is more moderated standard than the first blockage rate. When the relationship between the detected revolution rate and the detected air-flow rate falls outside the first permissible range, the diagnostic means determines that an abnormality has occurred in the air-flow rate sensor.

In addition, when the relationship between the detected revolution rate and the detected air-flow rate falls within the first permissible range but is outside the second permissible range, the diagnosis means determines that the ventilation condition has been degraded.

Moreover, when the diagnostic means determines that the ventilation condition has been degraded, first, the combustion means reduces the fuel supply, and then, when an air flow rate that corresponds to the amount of supplied fuel can not be detected, the diagnostic means again determines that the ventilation condition has been degraded, and detects either a malfunction of the combustion or the life is terminated.

According to the present invention, when the combustion device is to be used while the diagnostic means is performing the self-diagnosis for the ventilation condition, the diagnosis is halted and combustion is begun at the request of a user.

DETAILED DESCRIPTION OF THE PREFERRED EMBODIMENTS

The preferred embodiments of the present invention will now be described in detail while referring to the accompanying drawings.

The technical scope of the present invention is not limited to these preferred embodiments as long as no particular description is provided in the following explanation for restricting the present invention.

[First Embodiment]

Figure 1:
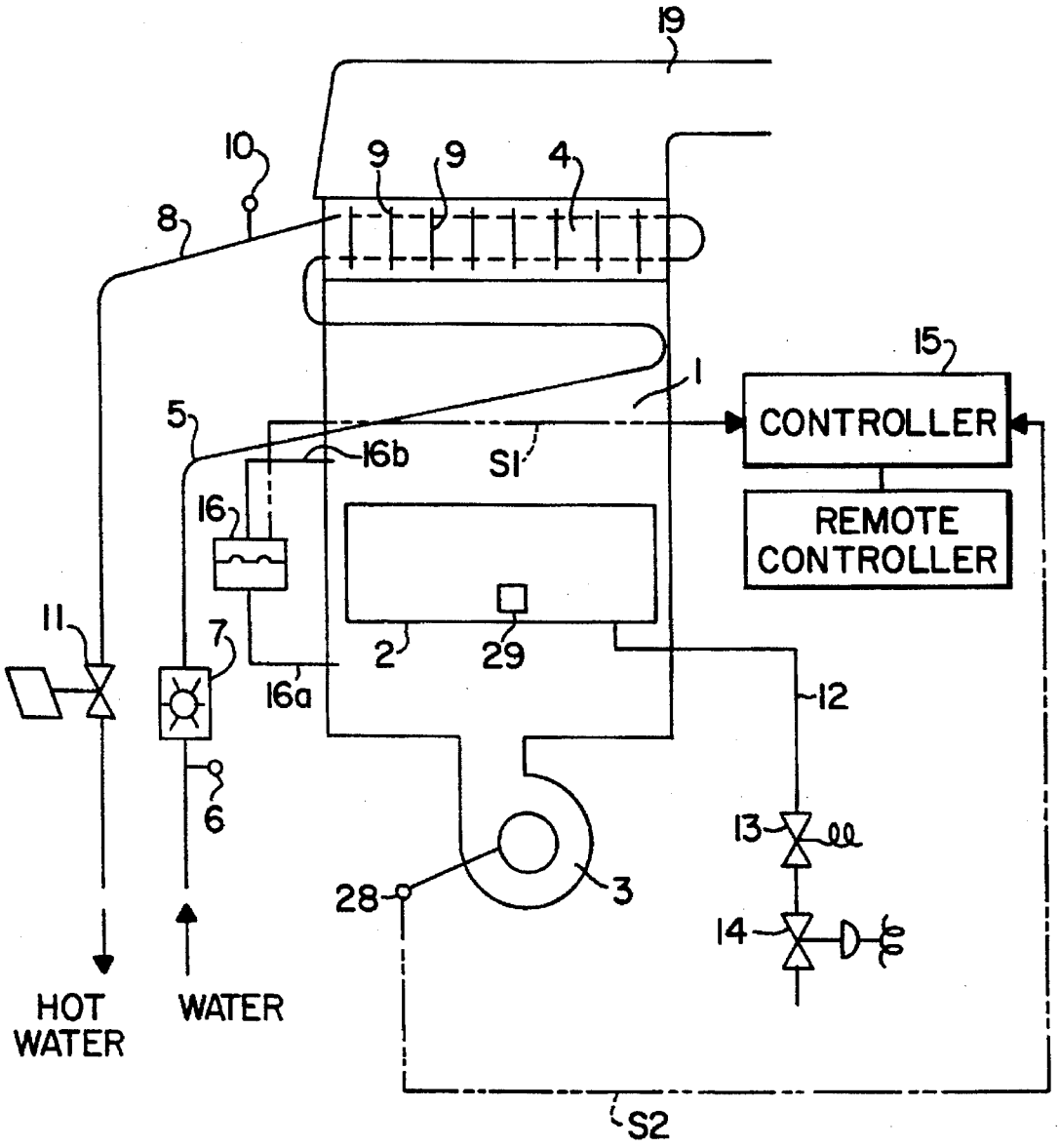
FIG. 1 is a diagram illustrating a water heater that is a combustion device according to an embodiment of the present invention.

In FIG. 1 is shown the structure of a system in a water heater that is one example of a combustion device of the present invention.

In FIG. 1, a burner 2 is located in the lower portion of a combustion chamber 1 of the water heater. A combustion fan 3 for performing air-intake and flue ventilation is provided below the burner 2. A revolution rate sensor 28 is provided for the combustion fan 3.

In the upper portion of the combustion chamber 1, a heat exchanger for a hot water supply is located between the combustion chamber 1 and a flueway 19. The heat exchanger 4 for a hot water supply is equipped with fins 9. A water supply pipe 5 is connected to the inlet of the heat exchanger 4. Along the water supply pipe 5 are provided a water temperature sensor 6, such as a thermistor, for detecting the temperature of the entering water, and a water flow rate sensor 7, for detecting the flow rate of the water.

A hot-water pipe 8 is connected to the outlet of the heat exchanger 4. Along the hot-water pipe 8 are provided a hot water temperature sensor 10, such as a thermistor, for detecting the temperature of hot water that flows from the heat exchanger 4, and a water flow control valve 11, for controlling the flow rate of the hot water.

A solenoid valve 13 and a proportioning valve 14, for controlling the volume of the gas that is supplied, are provided along a gas supply line 12 of the burner 2.

An air-flow rate sensor 16 (also called a differential pressure sensor) is so located that it can detect the differential pressure between the upper and the lower sides of the burner 2. That is, one air feed pipe **16*a* of the air-flow rate sensor 16 is connected to an air supply section, for the burner 2, that is positioned between the burner 2 and the combustion fan 3. The other air feed pipe 16*b* is connected to an air exhaust section that is positioned between the burner 2 and the heat exchanger 4**.

In FIG. 1, a controller 15 is connected to the air-flow rate sensor 16. The controller 15 is also connected to—therefore a revolution rate detection sensor 28 for the combustion fan 3. Therefore, the controller 15 receives sensor output S1 from the airflow rate sensor 16 and revolution rate detection signals S2, for the combustion fan 3, from the revolution rate detection sensor 28. Also, a temperature sensor 29 is provided to detect the temperature in the combustion device or the ambient air temperature.

The outputs of the sensors, such as the air-flow rate sensor 16 and the revolution rate detection sensor 28, may be represented by, for example, voltage values when they are detected. It is obvious that the output of a predetermined unit can be converted into an actual air flow rate or an actual revolution rate, in accordance with that data in an individual conversion table, and employed. In the present specification, therefore, a sensor output that is called, for example, the output of the air-flow rate sensor is supposed to indicate either the sensor output value that is actually detected or a converted air-flow rate.

The above described controller is generally achieved with an electronic circuit board whereon a microcomputer is mounted. The controller is connected to sensors, such as the temperature sensors, the water flow rate sensor, the air-flow rate sensor and the revolution rate detection sensor, the solenoid valve, the proportioning valve, and the water flow control valve, and controls the combustion described above.

Figure 2:
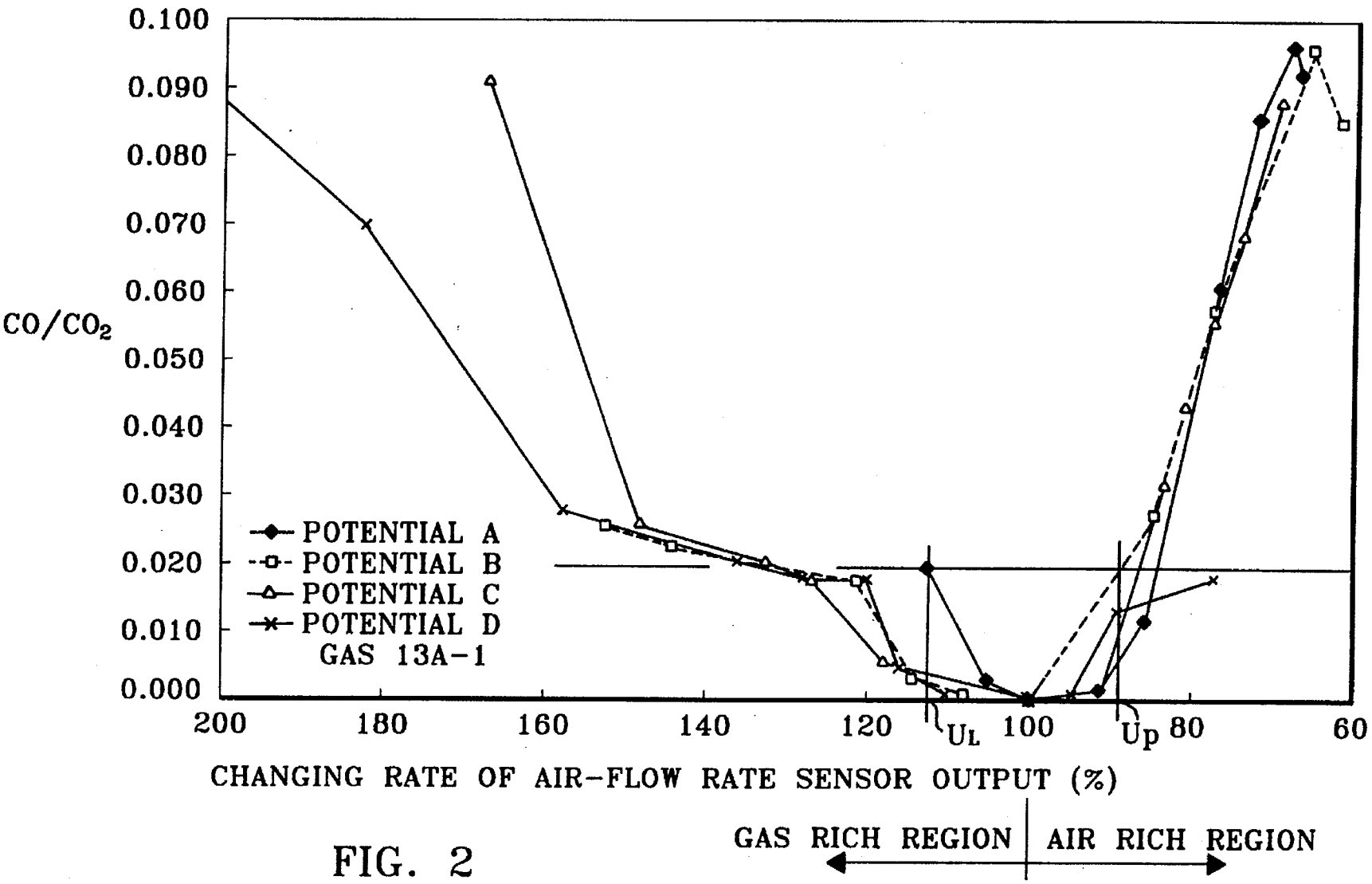
FIG. 2 is a graph showing the relationship between a change rate for an output by an air-flow rate sensor and a value for the $CO/CO_2$ in combustion exhaust gas.

The air-flow rate in the combustion device is controlled as is shown in the graph in FIG. 2, which depicts the relationship of a supplied air flow rate and the $CO/CO_2$ in exhaust gas. Four kinds of combustion capacities are shown in FIG. 2. That is, the degree to which the proportioning valve 14 is opened is adjusted in accordance with the magnitude of a combustion capacity, and a corresponding amount of gas is supplied as fuel. Air-flow rates that are optimal for the individual combustion capacities are supplied to the burner 2 by revolving the combustion fan 3. When the optimal air-flow rate is supplied, the change rate of the air-flow sensor output (which is represented by the horizontal axis in the graph in FIG. 2) is 100%. At this time, the quantity of $CO/CO_2$ in the exhaust gas is almost zero, as is shown in FIG. 2. That is, the rate of carbon monoxide relative to an air-flow rate that is required for the combustion is zero, and this means so-called complete combustion has been attained.

Thus, regardless of whether an air-flow rate that is to be supplied to the burner is greater or smaller than the optimal air-flow rate relative to the combustion capacity, the $CO/CO_2$ in the exhaust gas is increased. Generally, when that rate exceeds a predetermined value, for example, 0.020, this indicates that there is inappropriate combustion. That is, the ventilation is degraded due to a dust blockage, and as only an air-flow rate that is lower than the optimal rate can be supplied to the burner, the combustion is inappropriate. In other words, when the revolution rate of the combustion fan 3 is increased to supply an optimal air-flow rate, and the revolution rate that exceeds the maximum revolution rate of the fan is required, the optimal air-flow rate can not be supplied. In such a case, therefore, it must be determined that the combustion device is in an abnormal state or that the end of the useful life of the device has been reached (hereafter, simply stated as "the useful life of the device has ended").

Figure 3:
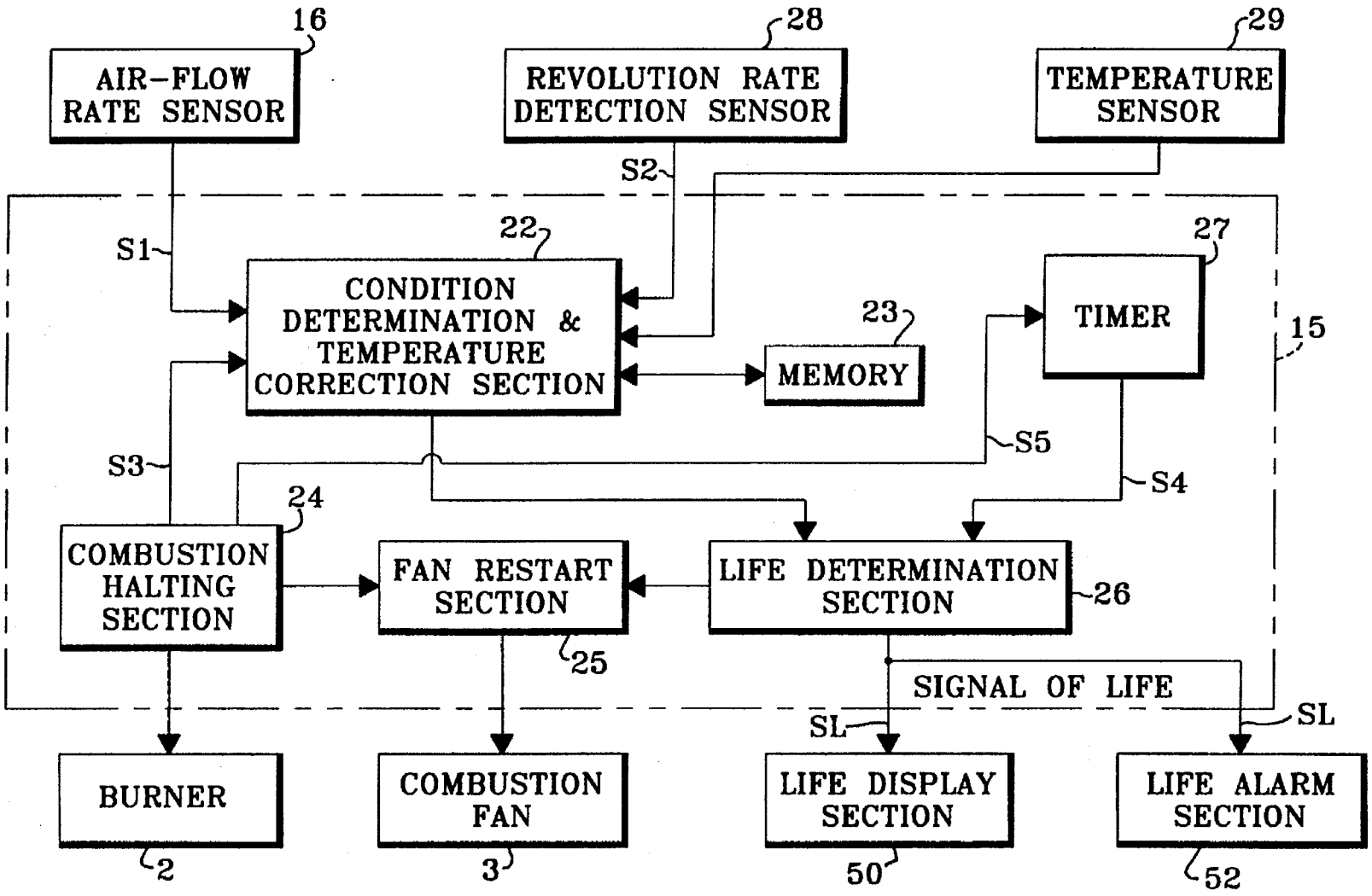
FIG. 3 is a block diagram illustrating the connections of a controller to its peripheral components in the water heater in FIG. 1.

FIG. 3 is a diagram illustrating an example of the connections of the controller 15 to the air-flow rate sensor 16, the revolution rate detection sensor 28 for the combustion fan 3, the burner 2, and the combustion fan 3.

The controller 15 includes a condition determination and temperature correction section 22, a memory 23, a combustion halting section 24, a fan restart section 25, a life determination section 26, and a timer 27.

When the controller 15 is achieved by using a microcomputer, the individual sections are constituted by a CPU and a recording medium in which a control program is stored.

In this embodiment, in order to determine an abnormality or the end of the useful life of the combustion device, while the revolution of the combustion fan 3 is controlled to provide a constant air-flow rate in the non-combustion state of the burner, a check is performed to determine whether or not the actual revolution rate of the combustion fan 3 falls within a permissible range that has an estimated value as its center. At this time, the permissible range is set to corrected values that are obtained in accordance with the ambient air temperature and/or the internal temperature of the combustion device. This is because, since the volume of air is increased as the temperature is raised, the revolution rate of the combustion fan that is required to supply the same amount of air is likewise increased.

In this embodiment, therefore, the controller 15 monitors the output of the air-flow rate sensor 16 while it controls the revolution of the combustion fan 3 so as to provide a predetermined air-flow rate. The controller 15 determines whether or not the output value of the revolution rate detection sensor 28 at this time has exceeded the upper limit of the permissible range which is corrected according to the temperature. When the output value has exceeded the upper limit value, the controller 15 outputs a signal SL that indicates the occurrence of abnormality or the end of the useful life.

The air-flow rate sensor 16, the revolution rate detection sensor 28, and a temperature sensor 29 are connected to the condition determination and temperature correction section 22 in the controller 15. The condition determination and temperature correction section 22 is connected to the memory 23. The condition determination and temperature correction section 25 receives a signal S3 that indicates whether or not the combustion halting section 24 is halting the combustion at the burner 2, and determines whether the burner 2 is in the non-combustion state.

Figure 4:
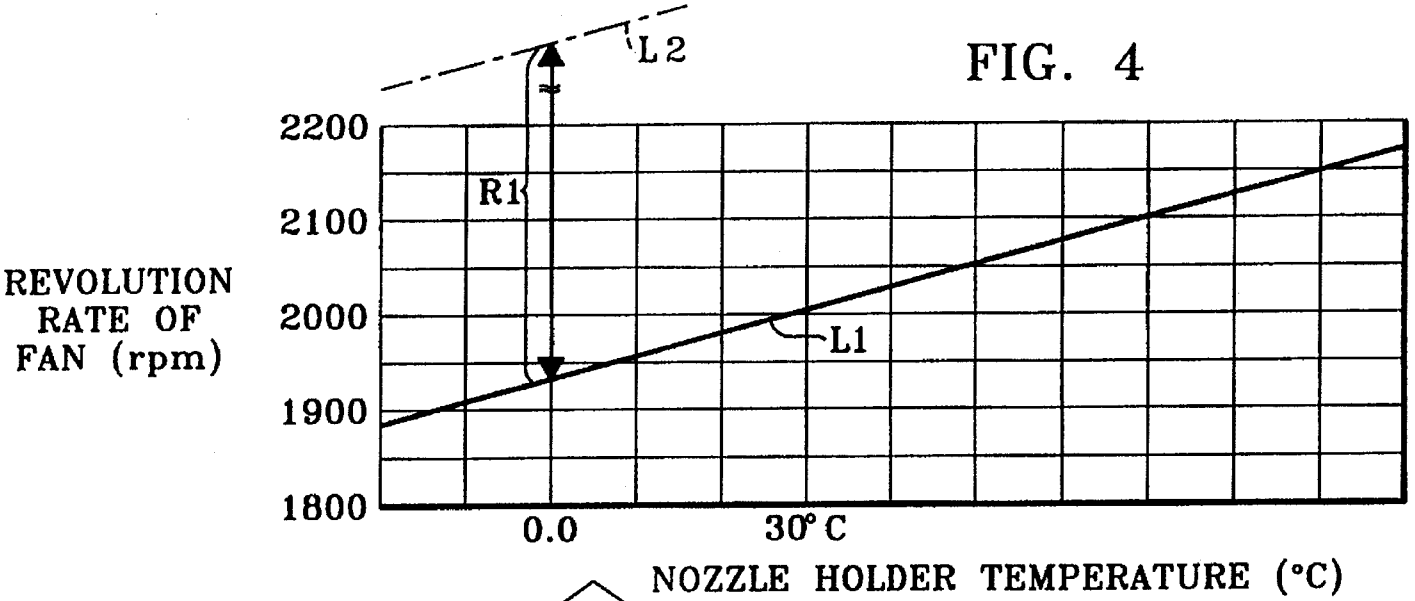
FIG. 4 is a graph showing one example of a relationship between a nozzle holder temperature (ambient air temperature), which is stored in a controller, and the revolution rate of a combustion fan.

In the memory 23 are stored the characteristics of changes in the revolution rate of the combustion fan related to changes in the ambient air temperature, under conditions wherein the sensor output of the air-flow rate sensor 16 is maintained constant as shown in FIG. 4. That is, in the memory 23 is stored a characteristic relationship between a nozzle holder temperature for the burner 2, which corresponds to the ambient air temperature and the revolution rate of the combustion fan 3, and as is shown in the example in FIG. 4.

The relationship between the nozzle holder temperature T(° C.) and the fan revolution rate in FIG. 4 can be expressed by the fan revolution rate R=5T+1930 (rpm) (straight line L1 in FIG. 4) that is shown as expression 1. In other words, it is assumed that the maximum fan revolution rate is 5000 rpm and the optimal revolution rate at the time the maximum combustion capacity is attained is 3400 rpm (at 30° C.). For the determination of the life span, 2080 rpm (at 30° C.), at which noise due to the fan revolution can be restricted even though the fan is stably revolved while in the non-combustion condition, is appropriately selected. As a result, the above described expression 1 is acquired. The above values are those that are obtained when the blockage rate is 0%.

On the other hand, the condition determination and temperature correction section 22 calculates expression 2: fan revolution rate R=5T (1930+the rise R1 of the revolution rate) (rpm) (straight line L2 in FIG. 4), which is acquired by increasing the value in expression 1 by a predetermined fan revolution rate (for example, by 520 rpm).

The rise R1 corresponds to an increase in the fan revolution rate when the blockage rate reaches 60%, for example. In the above described combustion device, when the blockage rate has reached 80%, the fan revolution rate that is required to attain the maximum combustion capacity is 5000 rpm, which is the maximum revolution rate. In order to provide a margin for the combustion device, however, a check is performed to determine whether or not the detected revolution rate falls within the rise R1 for the fan revolution rate that corresponds to the blockage rate of 60%.

The rise R1 in the revolution rate is 520 rpm, for example. The upper limit threshold value for the fan revolution rate, which is employed for determination of the lifetime, is approximately 2600 rpm at 30° C. according to expression 2. When the rise R1 in the revolution rate is defined as 970 rpm, the upper limit threshold value of the fan revolution rate at the time of a self-diagnosis is 3050 rpm at 30° C.

A signal S5 is transmitted to the timer 27 when the combustion halting section 24 halts the burner 2. When a predetermined time, for example, four to six hours, has passed, the timer 27 transmits, to the life span determination section 26, a signal S4 for determining the life span of the water heater. The reason the determination of the life is performed after a predetermined time has passed is that it is preferable that the determination be made when there is no variation in the internal temperature of the combustion device. The details will be explained later.

The fan restart section 25 revolves the combustion fan 3 to determine the life of the water heater while the burner 2 is held in the no combustion state by the combustion halting section 24.

A liquid crystal display, for example, can be employed as a life display section 50, and a buzzer can be used as a life alarm section 52. The lifetime display section 50 and the lifetime alarm section 52 are activated in response to a signal of life SL that is transmitted from the life determination section 26.

The operation in the first embodiment in FIGS. 1 through 4 will now be described.

The combustion halting section 24 of the controller 15 halts the combustion at the burner 2 and removes the water heater from the combustion state. More specifically, when a user closes a water tap (not shown), the water flow sensor 7 is turned off, the solenoid valve 13 and the proportional valve 14 are closed upon the receipt of a signal from the combustion halting section 24 of the controller 15, and the combustion fan 3 is set to the post-fan state and is thereafter finally turned off. At this time, the combustion halting section 24 transmits the signal S5 to the timer 27. In response to the signal S5, the timer 27 counts off a predetermined no combustion time period following the halting of the combustion at the burner 2, i.e., preferably four hours. When the timer 27 has counted off four hours, the timer transmits the life determination start signal S4 to the life determination section 26. Such a signal transmission must be delayed for four hours because by then the nozzle holder temperature will be almost the same as the ambient air temperature and will be stabilized. In other words, the operation must be delayed until the temperature of the air transmission system that is to be checked is stabilized. Then, the combustion fan 3 is revolved for ten seconds, for example, in order to perform a self-diagnosis of the water heater.

In this embodiment, the revolution of the combustion fan 3 is controlled while the output of the air-flow rate sensor is monitored, so that the output of the air-flow rate sensor corresponds to the value represented by the expression 1. The output of the revolution rate detection sensor 28 at this time is detected.

The condition determination and temperature correction section 22 fetches, from the memory 23, expression 1 which represents the fan revolution rate in the normal state (blockage rate of 0%) shown in FIG. 4. Then, the condition determination and temperature correction section 22 determines the existing condition based on expression 2, which represents the permissible upper limit value for the self-diagnosis and which is acquired by adding a predetermined rise R1 in the revolution rate to the expression 1.

When the ambient air temperature T is 30° C., for example, T=30 is substituted into expression 2 and the rise R1 in the revolution rate is defined as 520 rpm, so that the permissible value for the upper limit of the fan revolution rate is 2600 rpm. As is described above, 2600 rpm corresponds to the revolution rate when the blockage rate for the air-intake and flue ventilation line is approximately 60% due to dust, etc., that blocks the fins 9 of the water heater 4 in FIG. 1. Therefore, when the revolution rate detection signal S2, which the condition determination and temperature correction section 22 receives from the revolution rate detection sensor 28, indicates a revolution of approximately 2600 rpm, the life determination section 26 determines that the lifetime of the water heater has expired.

When the life determination section 26 determines that the lifetime of the water heater has expired, the life signal SL is transmitted to the life display section 50 and the life alarm section 52. The life display section 50 displays, for example, the characters "life," while the life alarm section 52 sounds a buzzer to notify a user.

As is described above, in the first embodiment in FIGS. 1 through 4, to determine whether the life of the water heater has ended from the characteristic relationship between the revolution rate of the combustion fan 3 and the output of the air-flow rate sensor 16, the condition determination and temperature correction section 22 in the controller 15 employs expression 2 for calculating the fan revolution rate at the time of life determination (while in the no combustion state) to obtain the upper limit value for the revolution rate during self-diagnosis. The life determination section 26 of the controller 15 compares the upper limit value for the revolution rate with the actual fan revolution rate that is obtained from the revolution rate detection sensor 28. When the actual fan revolution rate from the revolution rate detection sensor 28 is equal to or greater than the upper limit value for the fan revolution rate, the life determination section 26 can determine that the lifetime of the water heater has expired. In this manner, the useful life span of the water heater can be accurately determined while avoiding any influence due to changes in the ambient air temperature.

[Second Embodiment]

Figure 5:
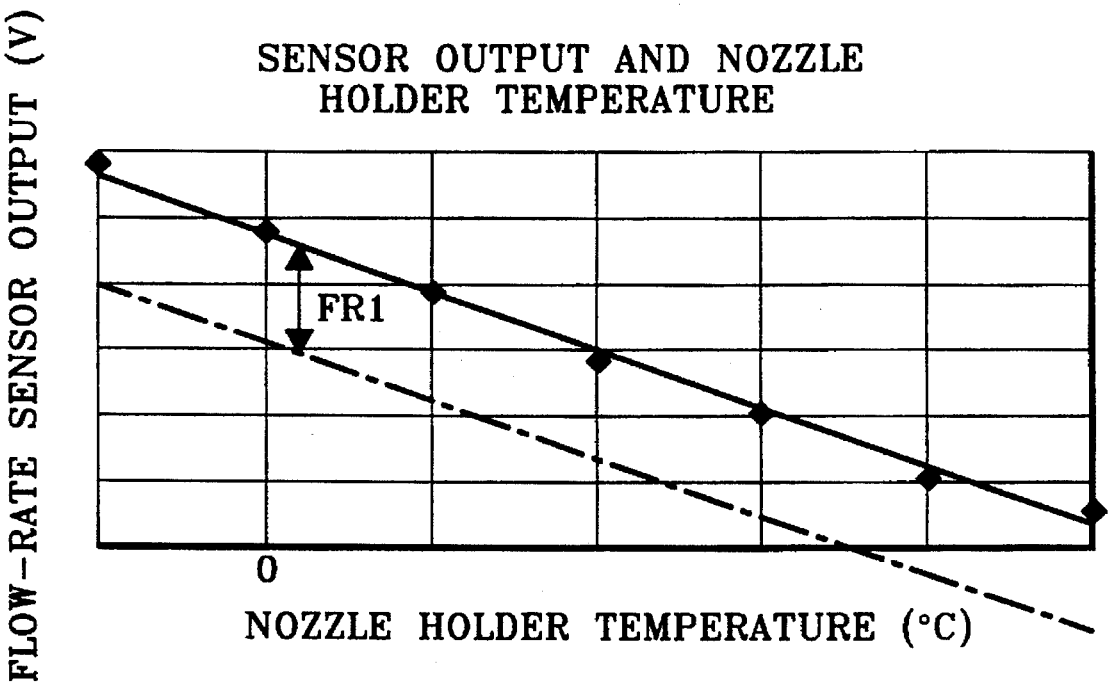
FIG. 5 is a graph showing one example of a relationship between a nozzle holder temperature (ambient air temperature), which is stored in the controller, and the output of an air-flow rate sensor.

In FIGS. 3 and 5 is shown a second embodiment of the present invention. Differences from the first embodiment concern information that is stored in a memory 23 and a determination method that is employed by a condition determination and temperature correction section 22.

In the memory 23 is stored a characteristic relationship, shown in FIG. 5, between the nozzle holder temperature, which is the ambient air temperature, and the sensor output of an air-flow rate sensor 16. The characteristic relationship represents the relationship between the temperature and an air-flow rate when the revolution rate obtained from a revolution rate detection signal S2 from a revolution rate detection sensor 28 is controlled to be 2100 rpm.

In the second embodiment, the fan revolution rate is adjusted, for example, to 2100 rpm, and a check is performed to determine whether or not an air-flow rate detected by the air-flow rate sensor is lower than the permissible lower limit value. At this time, the lower limit value for the air-flow rate that is corrected in accordance with the temperature change as shown in FIG. 5. In other words, as is shown in FIG. 5, the reduction FR1 in an air-flow rate that corresponds to a blockage rate of 60% is subtracted from the graph (solid line) for a case where there is a blockage rate of 0%, and the resultant graph (chained line) is employed as a permissible lower limit value. The permissible lower limit value is corrected in accordance with the temperature at the time of determination.

When the detected air-flow rate is lower than the permissible lower limit value that has been corrected in accordance with the temperature, the life determination section 26 transmits a life signal. SL to the life display section 50 and the life alarm section 52.

The present invention is not limited to the above described embodiments.

In the above embodiments, a burner of a two-level or three-level combustion switching type or of a multiple level combustion switching type, or a burner of a non-switching type can be employed as the burner 2.

The air-flow rate sensor 16 sandwiches the burner 2 by using a differential pressure sensor to detect the differential pressure between the upstream and the downstream portions of the burner 2. The air-flow rate sensor is not limited to this arrangement, as it only needs to detect the differential pressure at an arbitrary interval between the upstream and the downstream portions of the air ventilation path extending from the air supply section for the burner 2 to the exhaust line. That is, the differential pressure at the interval between the air intake port of the combustion fan and the combustion chamber, the differential pressure at the interval between the air outlet of the combustion fan and the combustion chamber, the differential pressure between the air intake or the air outlet of the combustion fan and the exhaust chamber in the upper portion of the water heater, and the differential pressure at the interval between the combustion chamber and the exhaust chamber can all be selected. When the air-flow rate sensor 16 is so located that it sandwiches the burner 2, as in the above embodiment, the dust blockages, etc., seldom occur at the burner 2. Thus, there is almost no transient change in the resistance that is encountered by air that passes through the burner 2, and the air-flow rate that is transmitted from the combustion fan 3 can be accurately detected by using the differential pressure. Therefore, a system for detecting an air differential pressure at the air path interval at which the burner is located is desirable.

A differential pressure sensor is employed as an air-flow rate sensor, but a hot-wire heater air-flow rate sensor or a Karman vortex air-flow rate sensor may be employed. Also, a propeller revolution air-flow rate meter for directly detecting an air-flow rate may be used.

In the above described embodiment, a single function water heater (a water heater that has only a hot water supply function) has been explained as an example of a combustion device according to the present invention. However, the present invention can be applied for a combined water heater that has both a hot water supply function and a supplementary bathtub water heating function, or that has both a hot water supply function and hot water circulated heating appliance function, and a combustion device which requires a burner for various devices, such as a bathtub water heater, a space heating appliance, cooling equipment, cooling and heating equipment, and an air conditioning device.

Although, in the above embodiment, the temperature of the nozzle holder is used as the ambient air temperature, the temperature at another portion can be used. In FIG. 3, only one, at least, of the life display section 50 and the life alarm section 52 need be provided.

In the first embodiment, the determination of the ventilation degradation is based on whether or not the detected revolution rate when a predetermined air-flow rate is controlled exceeds the permissible revolution rate corrected in accordance with the temperature. As another method, the predetermined air-flow rate is corrected with respect to the temperature according to the graph in FIG. 5, and the determination of the ventilation degradation can be based on whether or not the detected revolution rate when the detected air-flow rate is controlled to be the corrected air-flow rate, exceeds the permissible upper limit value at the standard temperature (for example, 0° C.) shown in the graph in FIG. 4. The same method that is described above can be employed for the second embodiment.

[Third Embodiment]

A third embodiment will now be explained. In the third embodiment and also in the fourth embodiment, four points are taken into consideration when determining the presence of an abnormality or the life (hereafter simply referred to as "life") of a combustion device. First, the revolution rate of a combustion fan and an air-flow rate are corrected based on the temperature at the time of self-diagnosis. This is the same as explained above for the first and the second embodiments. Second, a self-diagnosis is performed when there is no variance in temperature in the combustion device. For this reason, self-diagnosis is performed when the device is in a state of non-combustion, several hours after combustion has been terminated. Third, any influences due to the malfunctioning of sensors and to the ambient air velocity are eliminated before a self-diagnosis is performed. Fourth, before the final determination of the abnormality or the life of the combustion device, the combustion of the combustion device is controlled under a reduced capacity condition. Self-diagnosis by the combustion device can more appropriately be performed when the above points are taken into account.

Figure 6:
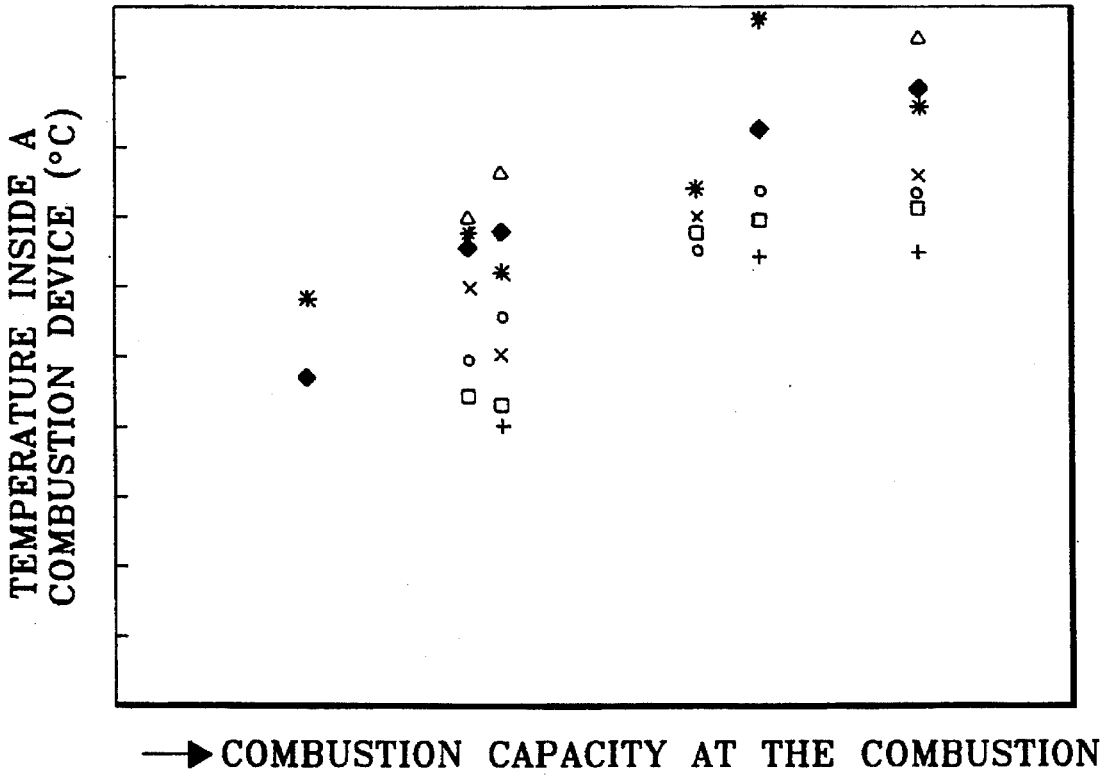
FIG. 6 is a graph showing the distribution of temperatures in individual sections of the water heater immediately after the combustion in the heater is halted.
Figure 7:
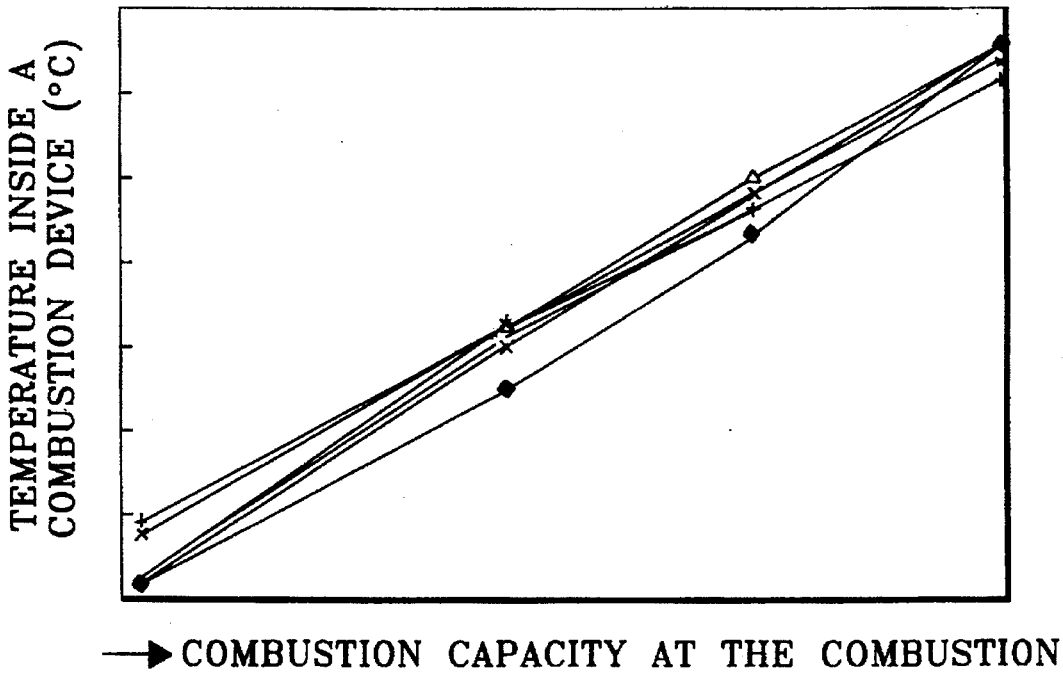
FIG. 7 is a graph showing the temperatures in individual sections of the water heater after the distribution of those temperatures is reduced and has become uniform when a predetermined time has passed following the halting of the combustion in the heater.

FIGS. 6 and 7 are graphs for explaining the second point.

FIG. 6 is a graph showing the temperatures in the individual sections of a water heater immediately after combustion in the heater is halted. The vertical axis represents the temperatures of the individual sections in the device, while the horizontal axis represents the capacity at the time of combustion. As is apparent from the graph, immediately after combustion is halted, temperature variances at individual sections is great in some portions no matter which capacities are taken. It has been confirmed by the present inventor that these variances remain constant for ten seconds following the halting of combustion. Thereafter, the temperature variances between the sections in the device are reduced gradually.

FIG. 7 is a graph showing the measured air temperature in the individual sections of the device when four hours have passed following the halting of combustion in the water heater. As is shown, when a comparatively long time has passed following the halting of combustion, the variances in the temperatures of the individual sections are reduced, and they become nearly uniform. In this embodiment, experimentation is performed to acquire the time that is required for the reduction of the variances in the air temperatures of the individual sections after combustion has been halted and for making the temperatures uniform, and the acquired time period is employed as a waiting time.

Figure 8:
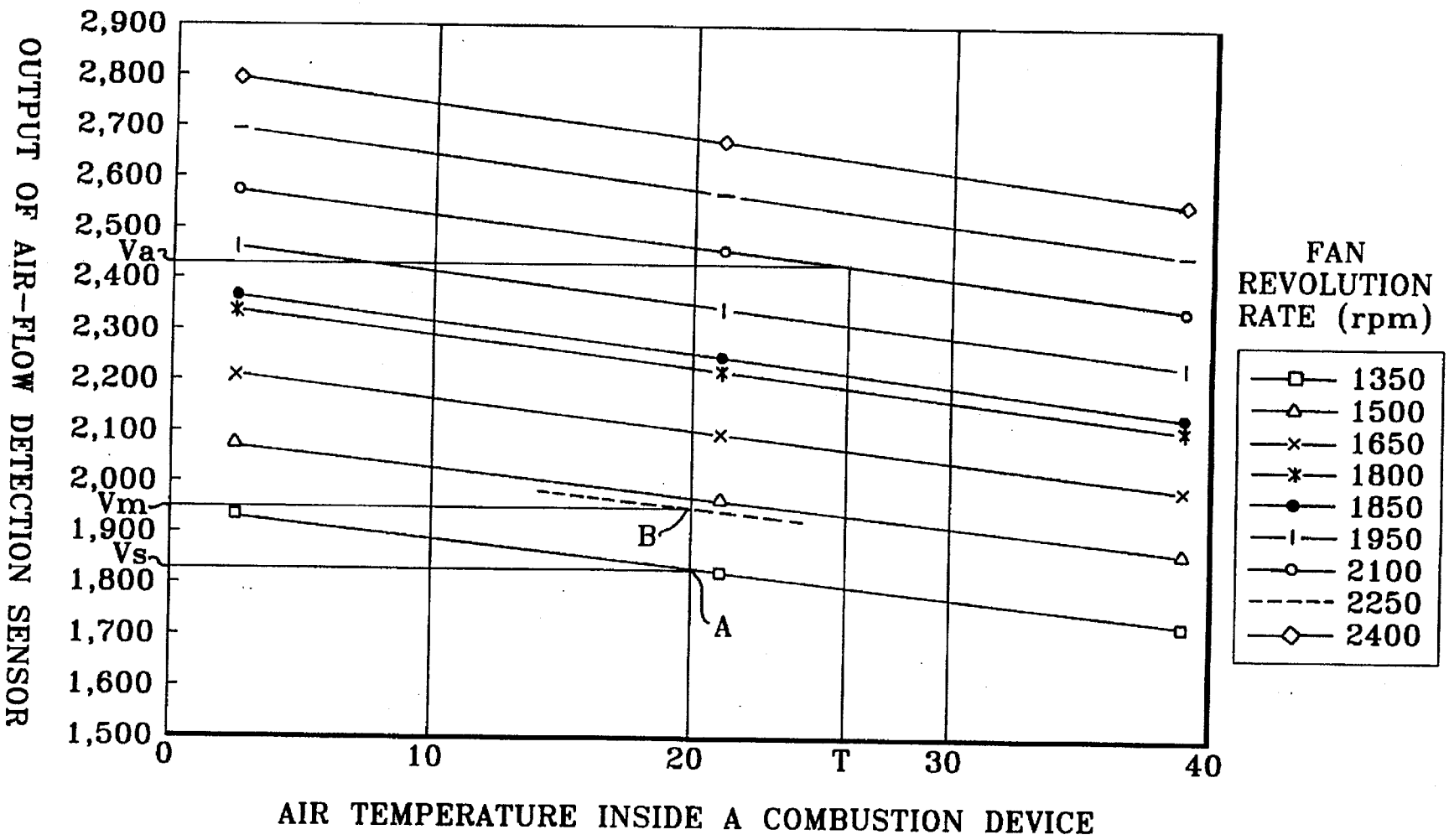
FIG. 8 is a graph showing temperature dependence of an output value of the air-flow rate sensor relative to the temperature in the device, with the fan revolution rate being employed as a parameter.

The above first point to be considered for temperature correction is as shown in FIGS. 4 and 5. In addition, the graph in FIG. 8 shows in more detail the same characteristic as is shown in FIG. 5. In other words, the graph shows the relationship between the air-flow rate and the temperature with different fan revolution rates. It should be noted that in this graph, the blockage rate is 0%.

In this embodiment, an explanation will be given while using the combustion device shown in FIG. 1 as an example. Though not shown in FIG. 1, a burner 2 is an assembly of a plurality of burners, for which combustion is individually controlled.

Figure 9:
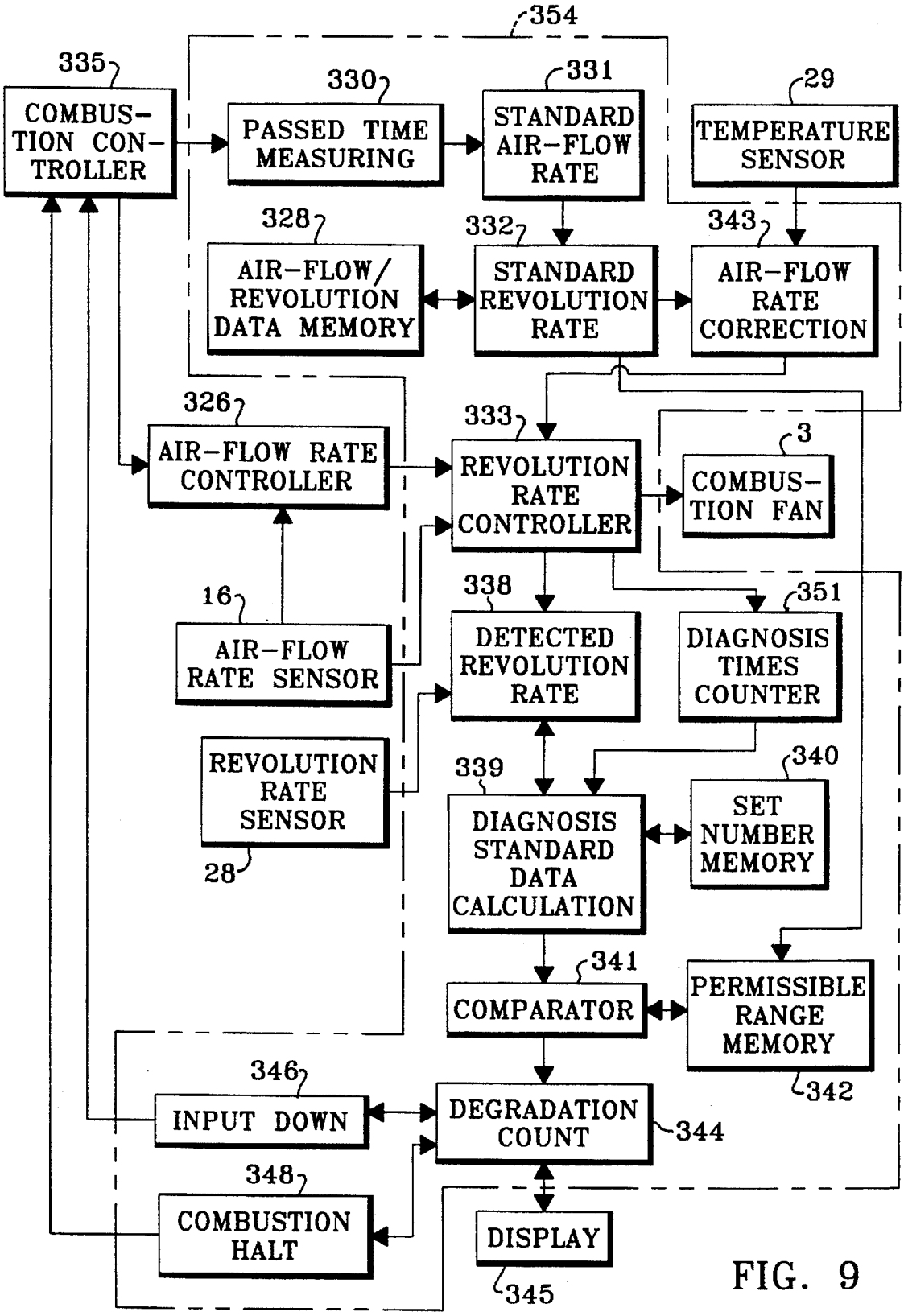
FIG. 9 is a block diagram illustrating the arrangement of the essential portion of a controller in a combustion device according to a third embodiment of the present invention.

In FIG. 9 is shown the functional arrangement of a controller 15 that has a self-diagnosis section, which is the feature of this embodiment. As is shown in FIG. 9, the controller 15 includes a combustion controller 335, an air-flow rate controller 326 and a self-diagnosis section 354.

The combustion controller 335 acquires a required combustion calorific value (a required gas supply volume), by feed forward and feed back calculations, from a supplied water flow rate that is detected by a water flow rate sensor 7, the temperature of the supplied water that is detected by a water temperature sensor 6, the temperature of hot water that is detected by a hot water temperature sensor 10, and information concerning a preset temperature that is given by a remote controller, etc., to provide hot water having a the temperature same as to the preset temperature. Additionally, the combustion controller 335 controls a drive current for opening a proportioning valve 14 to obtain the required combustion calorific value.

The air-flow rate controller 326 holds control data that indicates the relationship between the combustion calorific value and a target air-flow rate therefore, and acquires, from the control data, a target air-flow rate that matches the required combustion calorific value acquired by the combustion controller 335. For the combustion, the air-flow rate controller 326 employs a fan revolution rate detection signal from the fan revolution rate detection sensor 28 to control the revolution of a combustion fan 3, so that the target air-flow rate is detected by an air-flow rate sensor 16. Then, combustion is controlled while matching of the air-flow rate control of the air-flow rate controller 326 and the combustion control of the combustion controller 325 is performed.

The self-diagnosis section 354 in this embodiment revolves the combustion fan 3, under the standard setup conditions where the airsflow rate becomes a predetermined test standard air-flow rate as an example, when the self-diagnosis is performed after a specific time (e.g., four hours) has passed following the halting of combustion at the burner 2. The self-diagnosis section 354 determines the degradation of the ventilation for a water heater based on detected data by the fan revolution rate detection sensor 28. As is shown in FIG. 9, the self-diagnosis section 354 includes functions of passed time measuring means 330, a test standard air-flow rate sensor output decision section 331, a test standard air-flow rate sensor output correction section 343, an air-flow rate/revolution rate data memory 328, a test standard fan revolution rate decision section 332, a fan revolution rate controller 333, a detected revolution rate storage section 338, a diagnosis revolution times counter 351, a diagnosis standard value calculator 339, a set revolution rate memory 340, a comparison and determination 341, a permissible revolution rate range memory 342, a degradation output count storage section 344, an input down command section 346, and a combustion halt command section 348.

The passed time measuring means 330, which incorporates a timer, receives a combustion halt signal from the combustion controller 335 or a flame extinction signal for a flame rod electrode (not shown), and measures the time that passes following the halting of the combustion in the water heater. The passed time measuring means 330 transmits the measurement result to the test standard air-flow rate sensor output decision section 331 time after time.

A waiting time following the halting of the combustion in the water heater is provided in advance for the test standard air-flow rate sensor output decision section 331. The waiting time is acquired in advance through experimentation and is provided as the time required, following the halting of combustion in the water heater, for the air temperatures at the sections in the device to become stable and uniform. This point has been explained in FIGS. 6 and 7. The time required for temperature variances to disappear following the termination of combustion is provided as a waiting time to the test standard air-flow rate sensor output decision section 331.

The test standard air-flow rate sensor output decision section 331 decides the test standard air-flow rate sensor output of the air-flow detection sensor 16 that corresponds to a target air-flow, which is supplied to the burner 2 by the combustion fan 3. For example, based on data for the relationship between the target air-flow rate and the output of the air-flow rate sensor 16 at a predetermined temperature, which is acquired in advance through experimentation, the test standard air-flow rate sensor output decision section 331 determines the test standard air-flow rate sensor output, and transmits it to the test standard fan revolution rate decision section 332.

The test standard fan revolution rate decision section 332 receives the test standard air-flow rate sensor output from the test standard air-flow rate output decision section 331, and determines the test standard fan revolution rate for the combustion fan 3 that corresponds to the sensor output. Based on data, which are stored in the air-flow rate/revolution rate data memory 328, concerning a relationship between the sensor output of the air-flow rate sensor 16 and the fan revolution rate, the test standard fan revolution rate decision section 332 determines a test standard fan revolution rate that corresponds to the test standard air-flow rate sensor output, and transmits it to the test standard air-flow rate sensor output correction section 343 and to the permissible revolution rate range memory 342.

Based on the temperature that is detected by an internal temperature detection sensor 29, the test standard sensor output correction section 343 corrects the test standard air-flow rate sensor output that corresponds to the target air-flow rate. As is shown in FIG. 8, a transmitted air volume from the combustion fan 3 varies depending on the air temperature. That is, although the fan revolution rate remains constant, the sensor output of the air-flow rate sensor 16 fluctuates in accordance with the temperature. Therefore, the test standard sensor output correction section 343 corrects the sensor output in the following manner to provide the test stand air-flow rate sensor output that corresponds to the air temperature detected by the internal temperature detection sensor 29.

FIG. 8 is a graph showing the relationship between the temperature in the device and the sensor output of the air-flow rate sensor 16 when the fan revolution rate remains constant. For example, when the test standard fan revolution rate is defined as 2100 rpm, the test standard sensor output correction section 343 calculates a temperature correction value for the test standard air-flow rate sensor output from the internal air temperature T by using the following expression:

$$V_a=\alpha T+\beta \quad (1).$$

The value $V_a$ is transmitted as the test standard air-flow rate sensor output to the fan revolution rate controller 333. It should be noted that $\alpha$ and $\beta$ in expression 1 are experimental values that are acquired from the graph in FIG. 8.

During normal combustion, the fan revolution rate controller 333 revolves the combustion fan 3 under the control of the air-flow rate controller 326. While self-diagnosis is being performed, the fan revolution rate controller 333 revolves the combustion fan 3 so that the sensor output of the air-flow rate sensor 16 is the standard air-flow rate sensor output $V_a$, which is the standard setup condition. And upon each revolution of the combustion fan 3, while self-diagnosis is being performed, the fan revolution rate controller 333 transmits a fan revolution Signal to the detected revolution rate storage section 338 and the diagnosis revolution times counter 351.

The diagnosis revolution times counter 351 receives the fan revolution signal from the fan revolution controller 333, and counts the number of times that the combustion fan 3 is revolved by the fan revolution controller 333 while self-diagnosis is being performed, and transmits the count to the diagnosis standard value calculator 339.

Each time the fan revolution signal is transmitted by the fan revolution controller 333 to the detected revolution rate storage section 338, the detected revolution rate storage section 338 fetches and stores the detected fan revolution rate from the fan revolution rate sensor 28.

A calculation circuit (not shown) is provided in the diagnosis standard value calculator 339. The diagnosis standard value calculator 339 compares the revolution times of the combustion fan 3 that is given by the diagnosis revolution times counter 351 with the set number that is provided in advance in the set number memory 340. When the combustion fan revolution times reaches the set number, a calculation that will be described later is performed. More specifically, when the number of the detected revolutions, which is stored in the detected revolution rate value storage section 338, has reached the count set in the set number memory 340, the calculation circuit is employed to acquire a diagnosis standard value for the detected revolution rate by means of a calculation process provided in advance.

In this embodiment, in the diagnosis standard value calculator 339, a calculation process for obtaining an average value of detected values is provided as a calculation process for acquiring a diagnosis standard value for the detected revolution rate. The diagnosis standard value calculator 339 in this embodiment serves as an detected average value calculator, which performs the process for acquiring the average value of detected values as a diagnosis standard value. The diagnosis standard value calculator 339 transmits the average value to the comparator 341.

Stored in the permissible revolution rate range memory 342 is the permissible revolution rate range, which is provided relative to the revolution rate that is determined by the test standard fan revolution rate decision section 332. The permissible revolution rate range is given as a range that has a small margin relative to the test standard fan revolution rate; for example, when the test standard fan revolution rate is 2100 rpm, the permissible revolution rate range is 2500 rpm or less. The permissible range is acquired with a blockage rate of 60%, for example, as a standard.

The comparator 341 compares the average value (diagnosis standard value) of the detected revolution rate with the permissible revolution rate range. When the diagnosis standard value for the detected revolution rate falls outside the permissible revolution rate range, the comparator 341 determines that degradation of ventilation is progressing, and outputs a ventilation degradation progress signal.

The degradation output count storage section 344 counts the number of times the ventilation degradation progress signal is output by the comparator 341 and stores that number.

The input down command section 346 latches the output count of the ventilation degradation process signals that is stored in the degradation output count storage section 344. When the count reaches "3," the input down command section 346 determines that the degradation of ventilation due to blockage by dust has progressed considerably even though the life of the device has not yet ended. The input down command section 346 transmits an input down command to the combustion controller 335, so that an air volume required for combustion is ensured even when further blockage occurs in the ventilation. Based on this input down command, the drive current for opening the proportioning valve 14 of the water heater is controlled and the opening at the proportioning valve 14 is throttled down to reduce the volume of the fuel that is supplied to the burner 3.

The combustion halt command section 348 fetches the number of times the ventilation degradation progress signal is output that is stored in the degradation output count storage section 344. When this number reaches "4," the combustion halt command section 348 determines that the degradation of ventilation has reached to the level that the life is ended at, and transmits a combustion halt signal to the combustion controller 335. That is, when the fan revolution rate exceeds a permissible value even though combustion is being performed in the input down mode, the combustion halt command section 348 determines that the life of the device has ended. More specifically, in the input down mode, a required air supply volume has been reduced and the revolution rate of the combustion fan 3 has been also reduced. However, when the revolution rate of the combustion fan 3 exceeds the permissible value while the degradation of ventilation is progressing, the combustion halt command section 348 finally determines that the life of the device has ended.

The ventilation degradation data display section 345 reads information concerning the number of times the ventilation degradation progress signal is output that is stored in the degradation output count storage section 344, and displays the information. The display is arranged as needed. For example, figures that are stored in the degradation output count storage section 344 may be displayed, or the ventilation degradation progress condition that corresponds to the figure may be displayed using characters, for example, "dust blockage present" or "input down control required."

Figure 10:
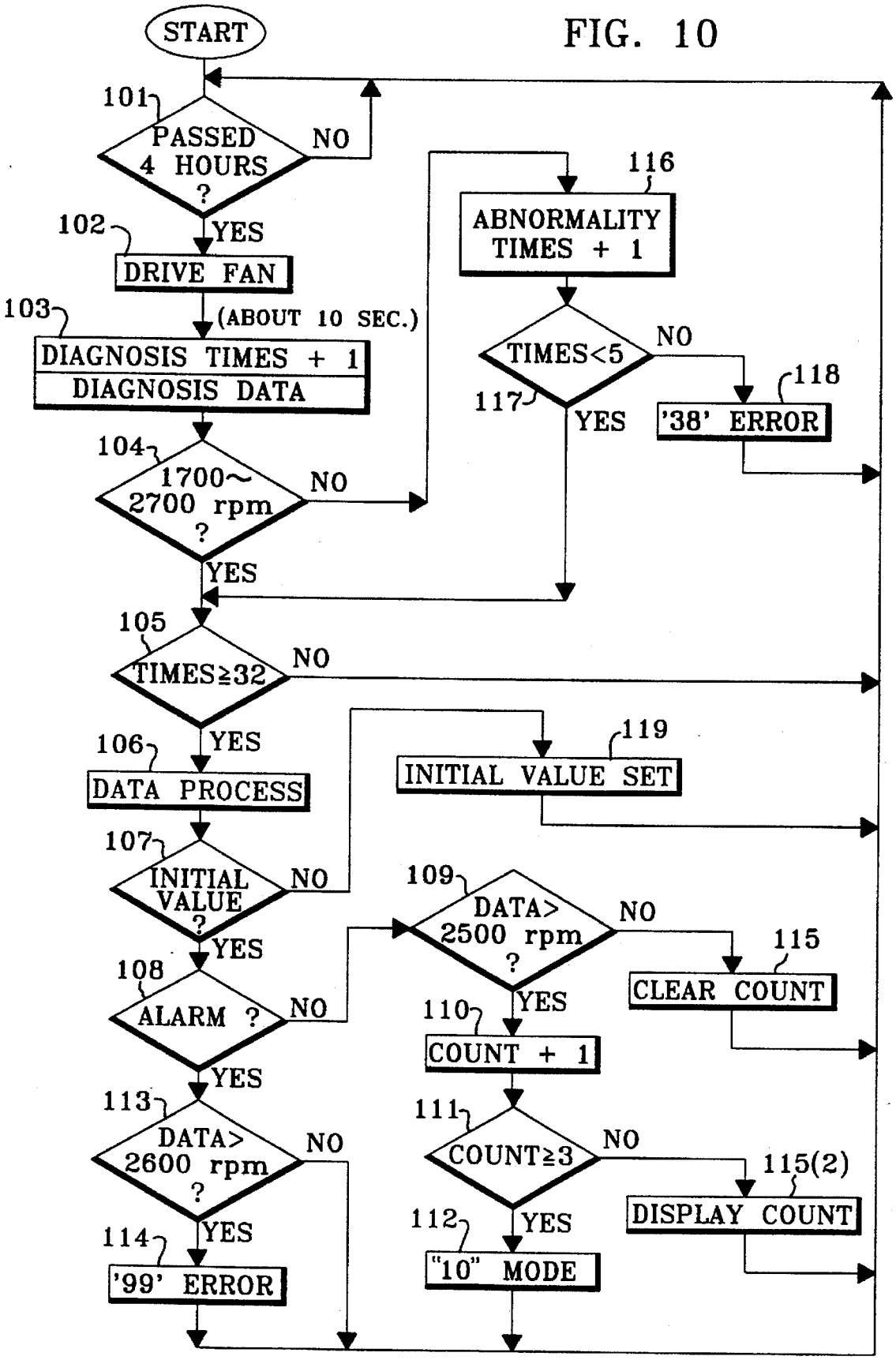
FIG. 10 is a flowchart for performing a self-diagnosis for ventilation degradation according to the third embodiment.

With this arrangement, the self-diagnosis operation in this embodiment will now be described while referring to the flowchart in FIG. 10. First, when normal and correct combustion has continued for 15 seconds or longer under the control of the combustion controller 335, the passed time measuring means 330 receives a combustion halt signal from the combustion controller 335, or a flame extinction signal from a flame rod electrode (not shown), and performs measurements to determine the time that has passed since combustion in the water heater was halted. At step 101, it is confirmed by the test standard air-flow rate sensor output decision section 331 that the passed time following the halting of combustion has reached four hours. At step 102, the fan revolution controller 333 drives the combustion fan 3 for about 10 seconds for self-diagnosis.

Before the combustion fan is driven, first, the test standard air-flow rate sensor output decision section 331 determines a temporary test standard air-flow rate sensor output that corresponds to a target air-flow rate. Then, the test standard fan revolution rate decision section 332 determines a test standard fan revolution rate that corresponds to the temporary test standard air-flow rate sensor output, and transmits the revolution rate to the test standard sensor output correction section 343. The test standard sensor output correction section 343 fetches a detected temperature from the internal temperature sensor 29 at this time, and corrects the temporary test standard air-flow rate sensor output, so that it becomes the test standard air-flow rate sensor output that corresponds to the detected temperature. Then, the corrected value ($V_a$) is transmitted to the fan revolution rate controller 333. At step 102, the fan revolution rate controller 333 revolves the combustion fan 3 so as to provide the corrected test standard air-flow rate sensor output $V_a$.

At step 103, the data that is detected by the fan revolution rate sensor 28 at this time is acquired as diagnostic data, and the number of diagnoses is defined as +1. At step 104, a check is performed to determine whether or not the diagnostic data is within 1700 to 2700 rpm, which is an abnormality determination range that is provided relative to the test standard fan revolution rate (e.g., 2100 rpm). When the diagnostic data falls within the abnormality determination range, the device is in the normal state and the program control advances to step 105.

When the diagnostic data falls outside the abnormality determination range, the diagnostic data is not stored in the detected revolution rate storage section 338, and at step 116, the number of abnormalities is defined as +1. The number of abnormalities is stored in an abnormality count storage section (not shown). As is described above, when the diagnostic data falls outside the abnormality determination range that is preset, the diagnostic data are not stored in the detected revolution rate storage section 338, but are counted as the number of abnormalities. In this manner, it is possible to prevent an erroneous self-diagnosis, which is caused by a downdraft or by a malfunction of the air-flow rate sensor 16. More specifically, when a downdraft enters from the outside through the flueway 19, it adversely affects an air-flow rate in the device, and the air-flow rate in accordance with the blockage condition can not be accurately detected. Since a downdraft occurs only for a moment, when such a phenomenon occurs only several times, the detected output on these occasions can be simply ignored. On the other hand, the air-flow rate sensor 16 may malfunction momentarily due to a strong impact, such as an earthquake. In this case, the detected fan revolution rate continuously differs greatly from a target value. Therefore, it is preferable that a predetermined error display be performed as an alarm signal, as will be described later.

At step 117, a check is performed to determine whether or not the number of abnormalities is less than five times. When the number of abnormalities is less than five times, it is determined that the diagnostic data fell outside the abnormality determination range because of a downdraft, for example. The program control moves to step 105, while the data are not fetched as diagnostic data. If, at step 117, the number of abnormalities is five or greater, at step 118, an error '38,' which indicates an abnormality at the air-flow rate sensor 16, is displayed when the water heater is used the next time. When, at step 104, it is determined even once that the diagnostic data falls within the abnormality determination range, the number of abnormalities is cleared.

As described above, at steps 104, 116, 117 and 118, the downdraft and the malfunctioning condition of the air-flow rate sensor can be cleared, and the blocking can be checked under the appropriate condition.

At step 105, a check is performed to determine whether or not the number of the detected revolution rate, which is stored in the detected revolution rate storage section 338 through the above operation, has reached the count in the preset number memory 340. In other words, in FIG. 10, a check is performed to determine whether or not the number of diagnoses that is counted by the diagnosis revolution times counter 351 has reached 32 times. When the number of diagnoses has reached 32 times, at step 106, the process for the diagnostic data is performed. In this embodiment, in the diagnostic data process, the calculation circuit in the diagnosis standard value calculator 339 averages the 32 sets of diagnostic data to obtain the average detected value. At step 107, a check is performed to determine whether or not there is an initial value. The initial value is a diagnosis standard value that is acquired the first time by the diagnostic data process. Since an initial value does not exist when the operation at steps 101 through 106 is first performed, at step 119, the result of the diagnostic data process (an average value for detected revolution rates) is set as the initial value. Then, the program control returns to step 101. In the initial state immediately after installation, the initial value is acquired from a difference between a detected fan revolution rate, which is required to obtain a predetermined air-flow rate, and a fan revolution rate that is calculated at the design stage. In other words, if, for example, the chimney at the flueway 19 of the combustion device is extended in accordance with the installation environment, the blockage rate is higher than the normal blockage rate. Therefore, some correction must be performed in accordance with such an installation environment.

When the second or later sequence of the operation at steps 101 through 106 is performed, it is assumed, at step 107, that an initial value is preset already. The program control thus moves to step 108. At step 108, a check is performed to determine whether or not an alarm signal is being output, i.e., whether or not the operating mode has entered the input down mode. The input down mode is begun when the diagnosis standard value (average value) acquired at step 106 falls outside the permissible revolution rate range that is stored in advance for the permissible revolution rate range memory 342 and when the number of the ventilation degradation progress signals output by the comparator 341 reaches three times. At this time, based on a command from the input down command section 346, the volume of the fuel supplied to the burner 2 is reduced in order to ensure an air volume that is necessary for combustion even if a ventilation blockage has occurred in the water heater to some extent.

If, at step 108, an alarm signal is not output, at step 109, the comparator 341 determines whether or not the diagnosis standard value exceeds 2500 rpm, which is the permissible revolution rate. When the diagnosis standard value exceeds the permissible revolution rate range, a ventilation degradation progress signal is output. At step 110, the output count of the ventilation degradation progress signals is defined as +1 and is stored in the degradation output count storage section 344. With the degradation output count being 1, when, at step 111, the output count of the ventilation degradation progress signals is three times or greater, at step 112, a mode '10' indicating the input down mode is displayed in the ventilation degradation information display section 345 of a remote controller. when, at step 111, the output count of the ventilation degradation progress signals is less than three, the output count of the signals is displayed by the ventilation degradation information display section 345. The program control thereafter returns to step 101.

If, at step 109, the diagnosis standard value (the average value for the detected revolution rates) is equal to or lower than 2500 rpm, which is the permissible revolution rate range, at step 115 the output count of the ventilation degradation progress signals that is stored in the degradation output count storage section 344 is cleared. The program control thereafter returns to step 101. In this manner, it is avoided that when the diagnosis standard value exceeds the permissible range even only once or twice, the combustion device responds sensitively to move into the input down mode.

If, at step 108, an alarm signal is being output, at step 113, a check is performed to determine whether or not processing data (diagnosis standard value) are greater than 2600 rpm. When the data are greater than 2600 rpm, at step 114, an error '99' that indicates the halting of combustion is displayed in the ventilation degradation information display section 345 when the remote controller is on. In other words, when the fan revolution rate exceeds the permissible value of 2600 rpm even though the combustion is controlled in the input down mode, this means that the blockage rate of the combustion device has reached a limit, and combustion is immediately halted.

In short, in this embodiment, when the fan revolution rate is other than 1700 to 2700 rpm, such a rate is inappropriate for a diagnosis and is not regarded as diagnosis revolution rate. At this time, when detected values other than 1700 to 2700 rpm are continued, an error indicating an abnormality at the air-flow rate sensor 16 is output. When the fan revolution rate falls within 1700 to 2700 rpm, it is stored in the memory as the diagnosis revolution rate. In this case, when the revolution rate exceeds 2500 rpm, the operation mode is switched to the input down mode. Further, when the revolution rate exceeds 2600 rpm, combustion is halted.

According to the embodiment, through the above described operation, the progressive ventilation degradation of the water heater can be sensitively and accurately checked based on data that are detected by the fan revolution rate sensor 28, each time the combustion fan 3 is so revolved that the sensor output of the air-flow rate sensor 16 matches the test standard air-flow rate sensor output $V_a$. In addition, since the status of the progressive ventilation degradation is displayed in the ventilation degradation information display section 345, a water heater user can easily and accurately understand how the water heater ventilation is being progressively degraded. Therefore, it is possible to employ this information to accurately determine if the life of the water heater has ended, and the maintenance of the water heater and the replacement of the heater can be appropriately performed.

As a result, it is possible to prevent the occurrence of a problem where such as the lifetime of a water heater is incorrectly determined to have expired with the result that the water heater is thereafter disposed of, even though the water heater is still performing satisfactorily and can continue to perform a preferable combustion operation. The waste due to an incorrect determination can be reduced.

According to this embodiment, it is possible to automatically perform combustion in the input down mode and combustion halting in accordance with the status of the progressive ventilation degradation. This makes it possible to avoid a dangerous condition, which occurs in conventional cases, where even though the combustion performance is greatly deteriorated by ventilation degradation, and the lifetime of a combustion device has expired, the fact that the lifetime has expired has not been determined because the combustion count and the combustion time have not reached set values, and the device thus continues to be used under the worst possible conditions for combustion.

In the third embodiment, the revolution of the combustion fan 3 is controlled so as to provide a predetermined air-flow rate. When the fan revolution rate at this time exceeds the permissible value, it is determined that the ventilation degradation is progressing. The predetermined air-flow rate is corrected in accordance with the temperature as the target air-flow rate. As another method, instead of correcting the predetermined air-flow rate in accordance with the temperature, the permissible value for the fan revolution rate may be so corrected. In other words, this is performed as is shown in FIG. 4.

[Fourth Embodiment]

In a fourth embodiment, the revolution rate of the combustion fan is adjusted to a predetermined value, and the output value of an air-flow rate sensor is detected at this time to determine how far the ventilation degradation has progressed. In this case, the fan revolution rate is corrected in accordance with the temperature. Except for this, the fourth embodiment is the same as the third embodiment.

Figure 11:
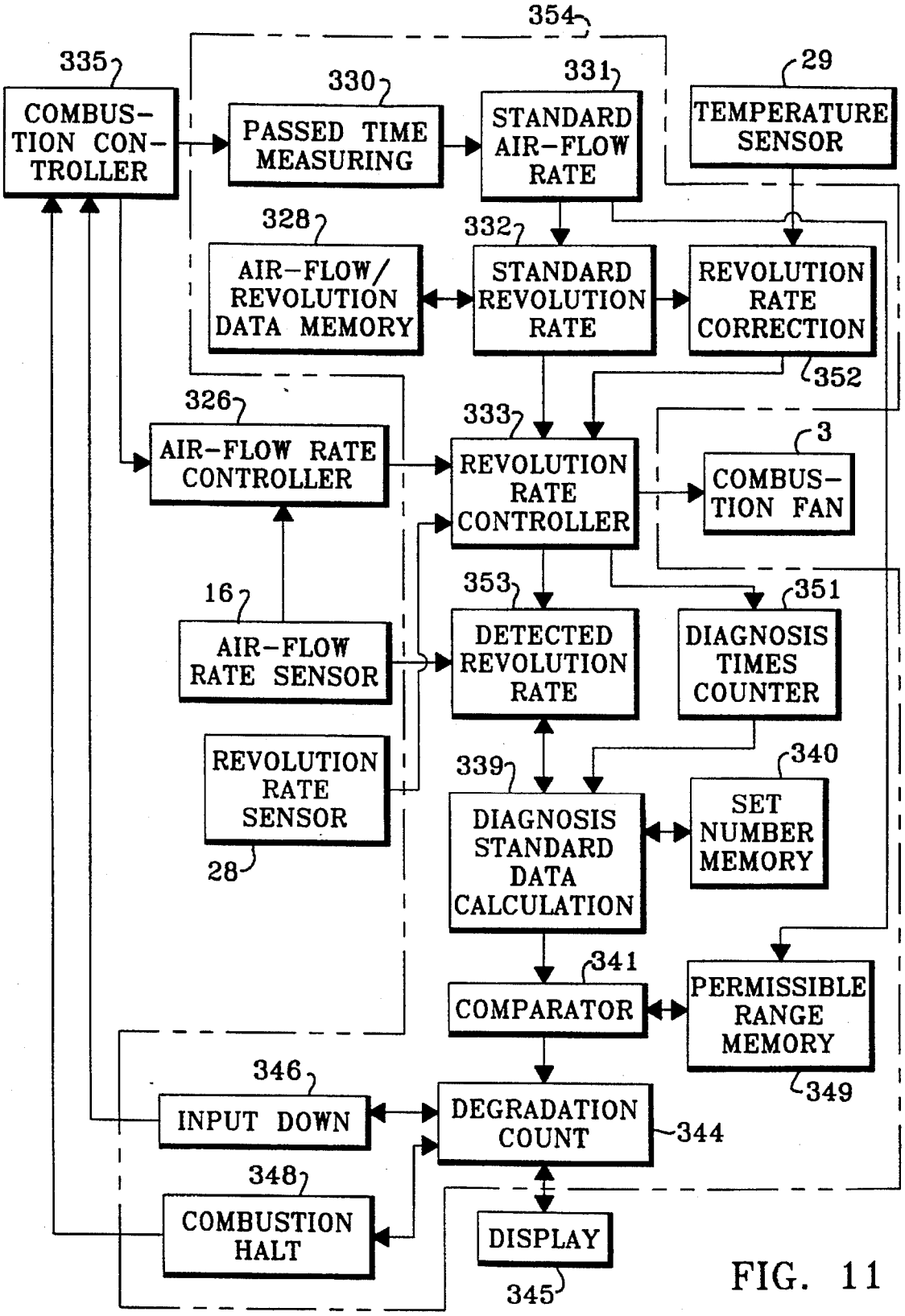
FIG. 11 is a block diagram illustrating the arrangement of the essential portion of a controller in a combustion device according to a fourth embodiment of the present invention.

FIG. 11 is a diagram showing the structure of the essential portion of a controller in the fourth embodiment. In this embodiment as well as in the third embodiment, a water heater with the system arrangement shown in FIG. 1 is employed and includes a combustion controller 335, an air-flow rate controller 326 and a self-diagnosis section 354. The characteristic difference of this embodiment from the third embodiment is that the self-diagnosis section 354 determines the ventilation degradation for the device based on data that are obtained by the air-flow rate sensor 16 when a combustion fan 3 is revolved under a preset standard condition during self-diagnosis.

As is shown in FIG. 11, the self-diagnosis section 354 in this embodiment includes a passed time measuring means 330, a test standard air-flow rate sensor output decision section 331, an air-flow rate/revolution rate data memory 328, a test standard fan revolution rate decision section 332, a test standard revolution rate correction section 352, a fan revolution controller 333, a detected air-flow rate value storage section 353, a diagnosis revolution times counter 351, a diagnosis standard value calculator 339, a set number memory 340, a comparator 341, a permissible air-flow rate range memory 349, an input down command section 346, a degradation output count storage section 344, and a combustion halt command section 348. The self-diagnosis section 354 is connected to a ventilation degradation information display section 345 that is provided on a remote controller.

In this embodiment, since the structures and the functions of the passed time measuring means 330, the test standard fan revolution rate decision section 332, the air-flow rate/revolution rate data memory 328, the diagnosis revolution times counter 351, the set number memory 340, the degradation output count storage section 344, the input down command section 346, the combustion halt command section 348, and the ventilation degradation information display section 345 are the same as those in the third embodiment, an explanation for them will not be given.

The test standard air-flow rate sensor output decision section 331 decides the test standard rate output of the air-flow rate sensor 16 that corresponds to a target air-flow rate, and transmits this value to the test standard fan revolution rate decision section 332 and to the permissible air-flow rate range memory 349, as in the third embodiment.

The test standard revolution rate correction section 352 corrects the test standard fan revolution rate based on the internal temperature that is detected by the temperature sensor 29. As is previously described, the air volume from the combustion fan 3 varies depending on the temperature. When the fan revolution rate is constant, the air-flow rate, i.e., the output of the air-flow rate sensor 16, varies due to changes in the temperature. On the other hand, when the air-flow rate (the output of the air-flow rate sensor 16) is constant, the fan revolution rate varies due to changes in the temperature. The test standard revolution rate correction section 352 corrects the test standard fan revolution rate, depending on the internal air temperature detected by the temperature sensor 29, by using, for example, data for the relationship between the internal air temperature and the fan revolution rate when the air-flow rate is constant. The resultant value is then transmitted to the fan revolution controller 333. It is as shown in FIG. 4, for example.

The fan revolution controller 333 in this embodiment revolves the combustion fan 3, so that the output of the fan revolution rate sensor 28 is the test standard fan revolution rate, which is given as the standard set condition by the test standard revolution rate correction section 352. Each time the combustion fan 3 is revolved during self-diagnosis, a fan revolution signal is transmitted to the detected air-flow rate storage section 353 and the diagnosis revolution times counter 351.

Each time the fan revolution controller 333 revolves the combustion fan 3 during self-diagnosis, the detected air-flow rate storage section 353 fetches, from the air-flow rate sensor 16, an air-flow rate for the air supplied to the burner 2 by the combustion fan 3 and stores the air-flow rate.

When the number of detected air-flow rates that are stored in the detected air-flow rate storage section 353 reaches the set number in the set number memory 340, i.e., when the diagnosis revolution rate for the combustion fan 3 that is counted by the diagnosis revolution times counter 351 reaches the set number, the diagnosis standard value calculator 339 performs a calculation process that is provided in advance to acquire the diagnosis standard value for the detected air-flow rates that are stored in the detected air-flow rate storage section 353. The diagnosis standard value calculator 339 in this embodiment also has a calculation circuit (not shown) as in the third embodiment, and uses the calculation circuit to calculate an average value for the detected air-flow rate values. The diagnosis standard calculator 339 also serves as an average value calculator in this embodiment.

In the permissible air-flow rate range memory 349 is stored a permissible air-flow rate range that is provided relative to the test standard air-flow rate sensor output, of the air-flow rate sensor 16, that is determined by the test standard air-flow rate sensor output decision section 331. The comparator 341 compares the permissible air-flow rate range with the diagnosis standard value (average of the detected values), which is received form the diagnosis standard value calculator 339. When the diagnosis standard value for the detected air-flow rate falls outside the permissible air-flow rate range, a ventilation degradation progression signal is output to the degradation output count storage section 344.

Figure 12:
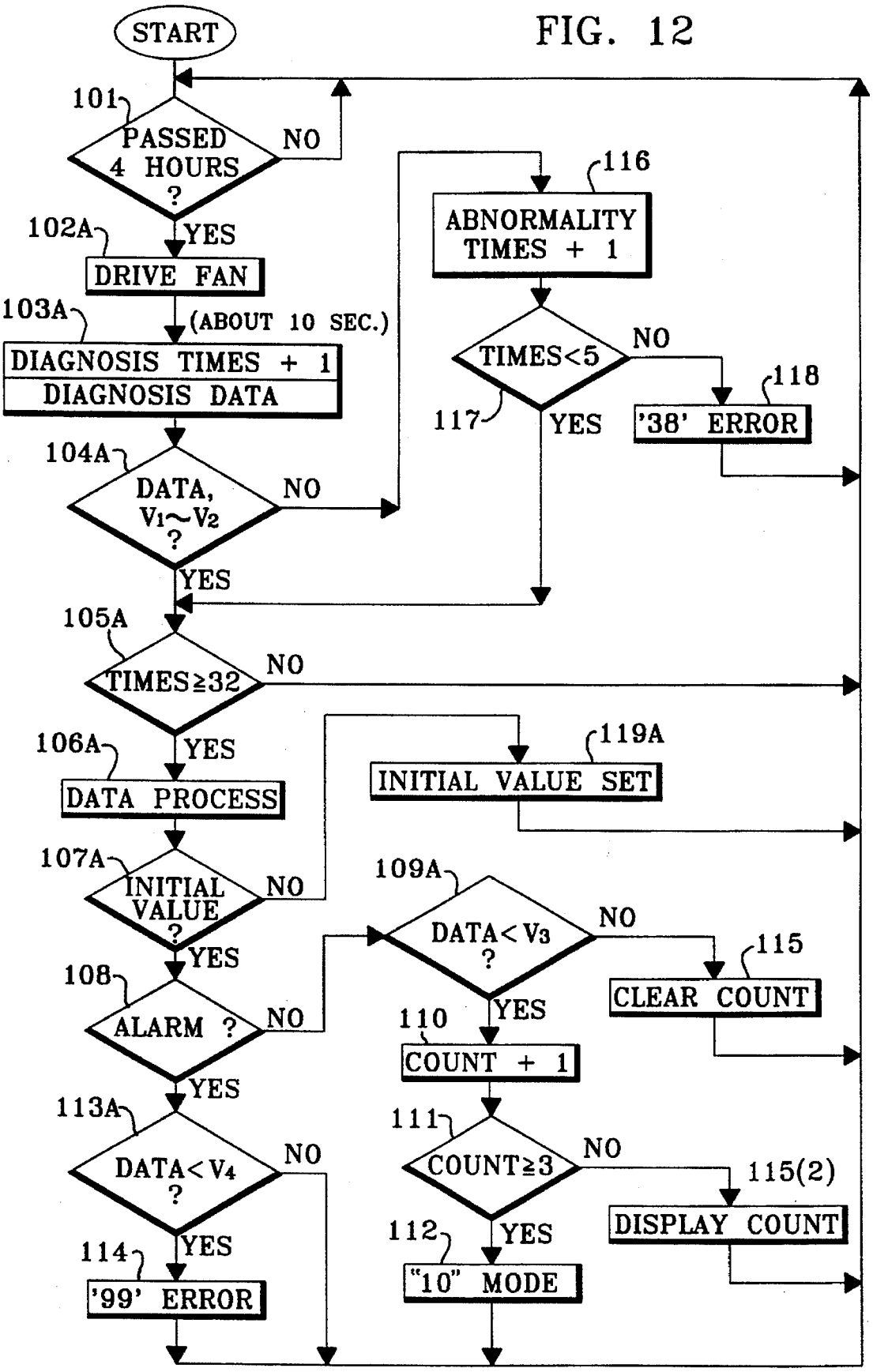
FIG. 12 is a flowchart for performing a self-diagnosis for ventilation degradation according to the fourth embodiment.

With the thus described arrangement, the self-diagnosis operation in this embodiment will now be described while referring to the flowchart in FIG. 12. The procedure at step 101 is performed in the same manner as in the third embodiment. When four hours, which is a predetermined setup waiting time, has passed following the halting of combustion, at step 102A, the self-diagnosis operation is begun, and the fan revolution controller 333 revolves the combustion fan 3 for about 10 seconds.

In this embodiment, before the combustion fan 3 is revolved, first, the test standard air-flow rate sensor output decision section 331 determines the test standard air-flow rate sensor output that corresponds to a target air-flow rate, and the test standard fan revolution rate decision section 332 determines the test standard fan revolution rate that corresponds to the determined test standard air-flow sensor output. The determined fan revolution rate is corrected by the test standard revolution rate correction section 352 based on the temperature that is detected by the internal temperature sensor 29. The combustion fan 5 is revolved according to the corrected test standard fan revolution rate. At step 103A, the volume of the air flow that is supplied to the burner 2 by the combustion fan 3 is detected by the air-flow rate sensor 16, and is regarded as diagnostic data.

At step 104A, a check is performed to determine whether or not the data (diagnostic data) detected by the air-flow rate sensor 16 falls within the $V_1$ to $V_2$ range, which is an abnormality determination range that is provided in advance. When the data detected by the air-flow rate sensor 16 falls outside the abnormality determination range, the process at steps 116 through 118 is performed as in the third embodiment.

If, at step 104A, the data from the air-flow rate sensor 16 that are acquired by the process at step 103A falls within the abnormality determination range, the program control advances to step 105A. At step 105A, the data detected by the air-flow rate sensor 16 are stored in the detected air-flow rate storage section 353. When the number of detected air-flow rates stored reaches the set number in the set number memory 340, a calculation process which will be described later is performed. That is, a check is performed to determine whether or not the number of diagnosis operations at steps 101 through 104A (the revolution rate of the combustion fan 3 during self-diagnosis), which is counted by the diagnosis revolution times counter 351, reaches the set diagnosis count (32 times in the flowchart). When the number of diagnosis operations reaches the set number, at step 106A a diagnostic data process is performed. In the diagnostic data process, the detected air-flow rate that is stored in the detected air-flow rate storage section 353 is calculated. In this embodiment, an average value calculation process is performed with the detected air-flow rates to acquire an average value.

At step 107A, as in the third embodiment, a check is performed to determine whether or not there is an initial value. At step 119A, the average value that is first acquired through the process at steps 101 through 106A is set as an initial value.

At step 108, as in the third embodiment, a check is performed to determine whether or not an alarm signal is being output. When an alarm signal is being output, at step 113A, a check is performed to determine whether or not the diagnosis standard value is smaller than the value $V_4$ that is determined in advance. When the standard value is smaller than the value $V_4$, at step 114 the above described error '99' is displayed on the remote controller. The value $V_4$ serves as the lower limit value of the air-flow rate.

If, at step 108, an alarm signal is not output, at step 109A, the comparator 341 determines whether or not the diagnosis standard value is smaller than the value $V_3$, which is the lower limit value of the permissible air-flow rate range that is set in the permissible air-flow rate range memory 349. When the diagnosis standard value is smaller than the value $V_3$, a process at steps 110 through 112 and at step 115(2) is performed in the same manner as in the third embodiment. When, at step 109A, the diagnosis standard value is equal to or greater than the value $V_3$, which is the lower limit value of the permissible air-flow rate range, the process at step 115 is performed in the same manner as in the third embodiment. The relationship of the values $V_1$, $V_2$, $V_3$ and $V_4$, is $V_1<V_4<V_3<V_2$, as in the third embodiment.

According to this embodiment, through the above described operation, the self-diagnosis section 354 revolves the combustion fan 3 under the standard set conditions during self-diagnosis, and based on data for the air-flow rate that is detected at this time by the air-flow rate sensor 16, the ventilation degradation of the device can be accurately determined based on the data. Thus, the same effect can be provided as is obtained in the third embodiment.

In this embodiment, in order to detect the progress of the ventilation degradation, the combustion fan is revolved at a predetermined revolution rate in the non-combustion state, and a check is performed to determine whether the air-flow rate detected at this time is smaller than the permissible lower limit value. In this process, the fan revolution rate is corrected in accordance with the temperature. It is, however, obvious that the same examination can also be performed by correcting the permissible lower limit air-flow rate value in accordance with the temperature. In other words, this is performed as is shown in FIG. 5.

The present invention is not limited to the above described embodiments, and various other modes can be employed. For example, in the above embodiments, a hot-wire anemometer is employed for the air-flow rate sensor 16; however, another type of sensor, such as a differential pressure sensor may be employed.

In the above embodiments, the test standard air-flow rate sensor output decision section 331 is provided to determine the test standard air-flow rate sensor output that corresponds to a target air-flow rate, and the test standard fan revolution rate decision section 332 is provided to determine the test standard fan revolution rate that corresponds to the test standard air-flow rate sensor output. However, the test standard air-flow rate sensor output and the test standard fan revolution rate are not necessarily determined by the self-diagnosis section 354, and may be provided in advance as data.

Further, in the above embodiments, the diagnosis revolution times counter 351 is provided to count the revolution times of the combustion fan 3 during self-diagnosis. However, such a counter may be eliminated and the diagnosis standard value calculator 339 may count the number of detected values that are stored in the detected revolution rate storage section 338 or in the detected air-flow rate storage section 353, so that when the count reaches the set number, the calculation process is performed.

In addition, in the above embodiments, the diagnosis standard value calculator 339 is defined as an average value calculator that calculates and acquires an average value for the detected values. The diagnosis standard value calculator does not always acquire the diagnosis standard value through the average value calculation process. For example, from among the detected values that are stored in the detected revolution rate storage section and in the detected air-flow rate storage section, the detected value whose number is the greatest is employed as a representative value for the diagnosis standard value.

Moreover, the input down command section 346 and the combustion halt command section 348 can be removed. However, in an arrangement where these command sections are provided and an input down command and a combustion halt command are issued in accordance with the output count, of ventilation degradation progress signals, that is stored in the degradation output count storage section, a dangerous combustion process that is being performed in a degraded ventilation condition can be prevented from continuing. It is, therefore, preferable that the input down command section 346 and the combustion halt command section 348 be provided.

Further, in the embodiments, the upper limit value of the permissible revolution rate range is stored in the permissible revolution rate range memory 342, while the lower limit value of the permissible air-flow rate range is stored in the permissible air-flow rate range memory 349; however, both the upper and lower limit values of the permissible range may be given to the permissible revolution rate range memory 342 and the permissible air-flow rate range memory 349.

In the fourth embodiment, in FIG. 8, when the sensor output value of a standard target air-flow rate is set to the value $V_m$ in advance, for example, and the temperature detected by the temperature sensor 29 is 20° C., point B at the intersection with the air-flow rate sensor output value $V_m$ may be acquired, and the straight line for the fan revolution rate that runs across point B may be obtained as is indicated by the dotted line. The fan revolution rate that is indicated by the dotted line may be defined as the standard fan revolution rate to perform the self-diagnosis in the same manner.

In the above embodiments, although the internal temperature sensor 29 that detects the air temperature in the device is provided at the nozzle holder, the temperature sensor 29 may be located at any place inside the combustion device (appliance) whereat the air temperature can be detected, and may be installed in another arbitrary device. Although a single temperature sensor 29 is provided in the above embodiments, a plurality of temperature sensors may be provided at different locations in the device. In such a case, when the variance in temperatures detected by the temperature sensors falls within the permissible range, an average value of temperatures in the temperature sensors is determined as the air temperature in the device, and in accordance with the temperature, the test standard air-flow rate sensor output and the test standard fan revolution rate can be set. Or, when the differential value $\alpha V/dt$ for the output value V of the internal temperature sensor 29 falls within the permissible range, the temperature at that time may be decided as the air temperature in the device, and the test standard air-flow sensor output and the test standard fan revolution rate may be set.

In addition, in the above embodiments, the ventilation degradation information display section 345 is provided in the remote controller and is connected to the self-diagnosis section 354. The ventilation degradation information display section 345 may be removed, or it may be provided in a display device other than a remote controller and a control unit, and may be connected as needed to the self-diagnosis section 354 by the transmission of signals. With this arrangement, a user of a combustion device, or a maintenance person, employs signals to periodically connect a device that includes a ventilation degradation information display section 345 to the self-diagnosis section 354, and reads the output count, of the ventilation degradation process signals, that is stored in the degradation output count storage section 344. In this manner, the ventilation degradation progression condition of the device can be confirmed.

Further, in order to shorten the waiting time that is required before the air temperature in the device becomes stable, either air cooling means that uses a fan (a combustion fan can be used) or water cooling means that feeds water may be provided in the device.

In the above embodiments, a single function water heater (a water heater with only a hot water supply function), as is shown in FIG. 1, is employed as a combustion device. The present invention can be applied to a combined water heater (a water heater with a hot water supply function and a bathtub water heating function, and a space heating function), and also to various combustion devices of a combustion burner type, such as space heating appliances, space cooling appliances, heating and cooling equipment, and air conditioners.

[Fifth Embodiment]

A fifth embodiment is applied to a combustion device shown in FIG. 1. In the fifth embodiment, the detection of an abnormality at an air-flow rate sensor 16 that has been explained at steps 104, 116, 117 and 118 in the third and the fourth embodiments is the prime object. Therefore, no explanation for those portions that overlap the third and fourth embodiments will be given.

Figure 13:
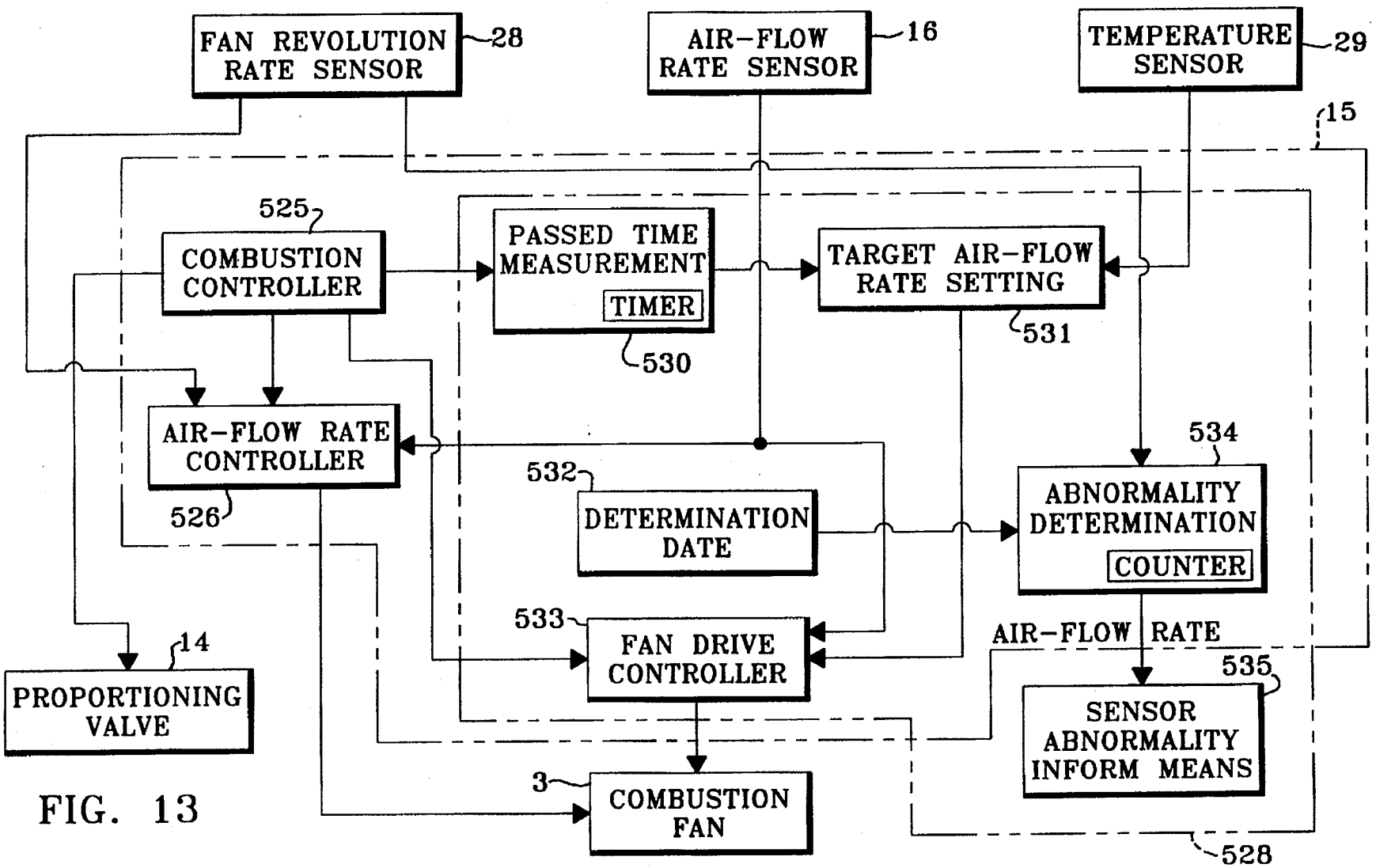
FIG. 13 is a block diagram illustrating the structure of an essential portion according to a fifth embodiment of the present invention.

In the fifth embodiment, as is shown in FIG. 13, a control unit 15 includes a combustion controller 525 and an air-flow rate controller 526, and a circuit for a unit 528, for checking an abnormality at the an air-flow rate sensor 16, which is the feature of this embodiment. The combustion controller 525 has the same function as the combustion controller 335 that was explained while referring to FIGS. 9 and 11. The air-flow rate controller 526 performs the same air-flow rate control as the air-flow rate controller 326. Thus, the detailed operations of these components are as was previously described, and no explanation for them will be given.

The abnormality check unit 528 in this embodiment includes an passed time measurement means 530, a target air-flow rate setting section 531, a determination data memory 532, a fan drive controller 533, an abnormality determination section 534, and a sensor abnormality notification means 535. The passed time measurement means 530, which incorporates a timer, receives a combustion halt signal from the combustion controller 525, or an flame extinction signal for a flame rod electrode, and measures the time that has passed following the halting of the combustion in a water heater. Each time the passed time measurement means 530 measures the passed time, it transmits it to a target air-flow rate setting section 531.

A set time for waiting following the halting of the combustion in the water heater is provided in advance for the target air-flow rate setting section 531. This waiting time is acquired through experimentation in advance, and is given as the time following the halting of the combustion in the water heater that is required for the air temperature in the heat water to be stabilized locally and become uniform. As this has been explained while referring to FIGS. 6 and 7, no further explanation will be given.

The target air-flow rate setting section 531 fetches the air temperature from the temperature sensor 29 when the waiting time has passed following the halting of the combustion in the water heater, and sets the value for a standard target air-flow rate for checking an abnormality of the air-flow rate sensor 16. The value of the standard target air-flow rate is acquired in FIG. 8, in the same manner.

That is, in FIG. 8, when the standard fan revolution rate is defined as 2100 rpm, and the target air-flow rate setting section 531 determines a target air-flow rate (sensor output) $V_a$ in accordance with the internal air temperature T. Through varying the target air-flow rate $V_a$ in accordance with the environmental temperature, the target fan revolution rate can be maintained at a constant 2100 rpm. When the temperature T is fixed, the target air-flow rate $V_a$ is temporarily determined. It should be noted that the standard fan revolution rate is the expected fan revolution rate when the air-flow rate sensor 16 is operating normally.

In the determination data memory 532 are stored determination data for detecting an abnormality at the air-flow rate sensor 16. The determination data are the upper limit determination value $N_{UP}$ and the lower limit determination value $N_{DN}$ for the combustion fan 3, with the standard fan revolution rate centered between them. In this embodiment, the upper limit determination value $N_{UP}$ and the lower determination value $N_{DN}$ are given for a range wherein a ratio of CO gas to $CO_2$ gas ($CO/CO_2$ value) in the exhaust gas is 0.020 or lower, while for combustion the fan revolution rate is adjusted to the fan revolution rate (standard fan revolution rate) for the target air-flow rate, and only the fan revolution rate is changed with the target air-flow rate.

FIG. 2 is a graph of experimental data that is a basis to acquire the set range for the upper and lower determination limit values. In this graph, the horizontal axis represents the changing rate of the air-flow sensor output, and the vertical axis indicates the $CO/CO_2$ in the exhaust gas. The change rate of 100% for the air-flow rate sensor along the horizontal axis means that the target air-flow for the optimal combustion is supplied to the burner. The right side of the changing rate of 100% is an excess air area (air rich area) in which the number of fan revolutions is increased. The left side of the changing rate of 100% is an air deficient area (gas rich area) in which the fan revolution rate is reduced. When the fan revolution rate is varied while the fan revolution rate at the sensor output changing rate of 100% is employed as the standard, the CO density in the exhaust gas is increased, and the device enters an abnormal combustion state.

In the graph in FIG. 2 is shown data (A<D) at four different combustion capacities A through D. According to each data, when the fan revolution rate is changed relative to the standard fan revolution rate at the changing rate of 100% for the air-flow rate sensor output, the CO density in the exhaust gas is increased, and the value for $CO/CO_2$ becomes great accordingly. In this embodiment, the point at which the $CO/CO_2$ value is 0.020 is regarded as the permissible limit level for a combustion abnormality. When the combustion at the burner is initiated for each combustion capacity, the upper and lower limit determination values. $N_{UP}$ and $N_{DN}$ for the fan revolution rate are set within the changing rate range for the minimum change widths $U_L$ and $U_P$ at which the $CO/CO_2$ value reaches 0.020.

Figure 14:
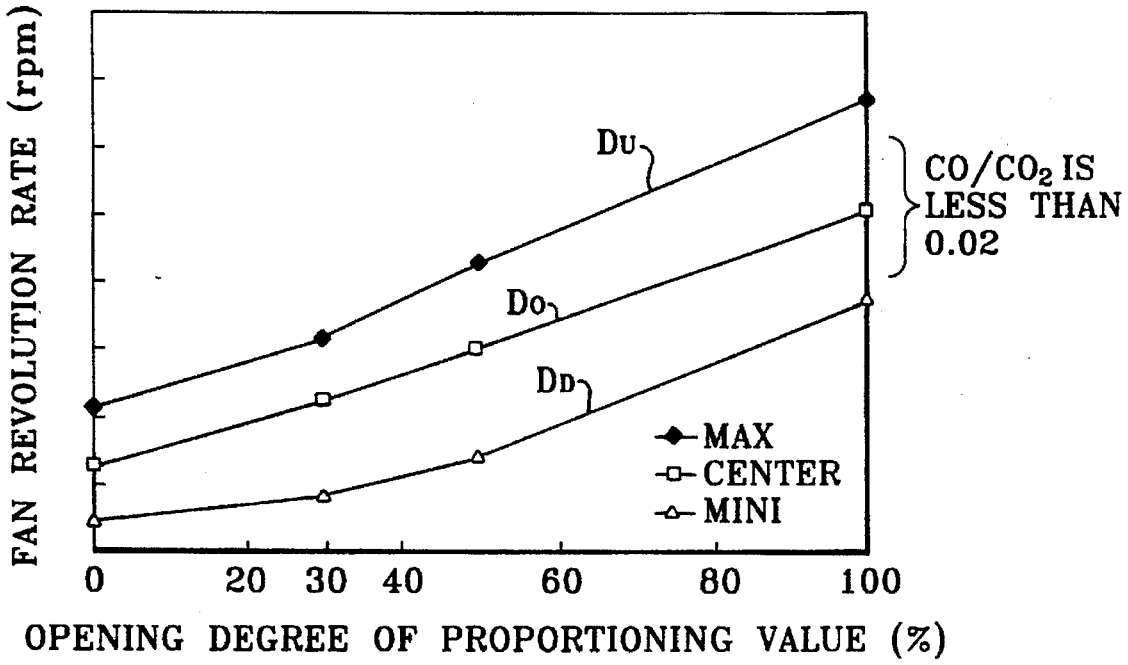
FIG. 14 is a graph showing the upper limit and the lower limit of fan revolution rate which provide a value of 0.02 for $CO/CO_2$ during combustion in the water heater with the referential fan revolution rate for a target air-flow rate as a center.

FIG. 14 is a graph showing the upper limit and lower limit range for the fan revolution rate at which, the $CO/CO_2$ reaches 0.020 at each combustion capacity value. In this graph, the center data $D_O$ is the revolution rate at 100% of the air-flow rate sensor output (the standard fan revolution rate for the target air-flow rate). Data $D_U$ is the fan revolution rate when the $CO/C0_2$ value reaches 0.020 after the fan revolution rate is incremented. Data $D_0$, on the contrary, is the fan revolution rate when the $CO/CO_2$ value reaches 0.020 after the fan revolution rate is decreased. With respect to the test revolution rate $D_0$, the upper and lower limit determination values $N_{UP}$ and $N_{DN}$ are given within the range between the data $D_U$ and $D_D$. Along the horizontal axis in this graph, the interval between the minimum combustion capacity and the maximum combustion capacity is equally divided into 100 segments, and the combustion capacities (the degree to which the proportioning valve is opened) are represented by %.

A fan driver 533 revolves the combustion fan 3 after the standard target air-flow rate is set by the target air-flow rate setting section 531. The fan driver 533 latches the air-flow rate that is detected by the air-flow rate sensor 16, and controls the revolution rate of the combustion fan 3 so that the detected air-flow rate matches the target standard air-flow flow rate that is set by the target air-flow rate setting section 531.

Incorporated in the abnormality determination section 534 is a counter. Further, when the revolution rate of the combustion fan 3 is controlled by the fan driver 533 in the above manner, the abnormality determination section 534 latches the current fan revolution rate output by the fan revolution rate sensor 28. Also, the abnormality determination section 534 latches, from the determination data memory 532, the upper and lower limit determination values $N_{UP}$ and $N_{DN}$ relative to the standard fan revolution rate for the standard target air-flow rate. Then, the abnormality determination section 534 determines whether or not the detected fan revolution rate falls within the range between the upper and lower limit determination values $N_{UP}$ and $N_{DN}$. When the fan revolution rate falls outside the range between the upper and lower limit determination values, the abnormality determination section 534 determines that an abnormality has occurred at the air-flow rate sensor 16, and increments the counter value by one.

In this embodiment, the checking for an abnormality at the air-flow rate sensor 16 is performed each time the combustion operation is halted. When the number of determinations that an abnormality exists at the air-flow rate sensor 16 reaches a determination standard count with once or more times, that is in this embodiment, when the number of determinations that an abnormality exists continues and reaches a set standard determination count (e.g., five times), the functioning of the air-flow rate sensor 16 is determined to be abnormal, and a sensor abnormality signal is output. When the combustion is initiated again before the waiting time that is set by the target air-flow rate setting section 531 passes following the halting of the combustion, the checking for an abnormality at the air-flow rate sensor 16 is not performed. This will be described later.

The sensor abnormality notification means 535 receives the sensor abnormality signal and issues a notification that the air-flow rate sensor 16 is functioning abnormally. Proper transmission means is employed for this notification. A buzzer, etc., for example, is sounded, characters and symbols are displayed on a liquid crystal screen of a remote controller, or a lamp is turned on or blinks.

Figure 15:
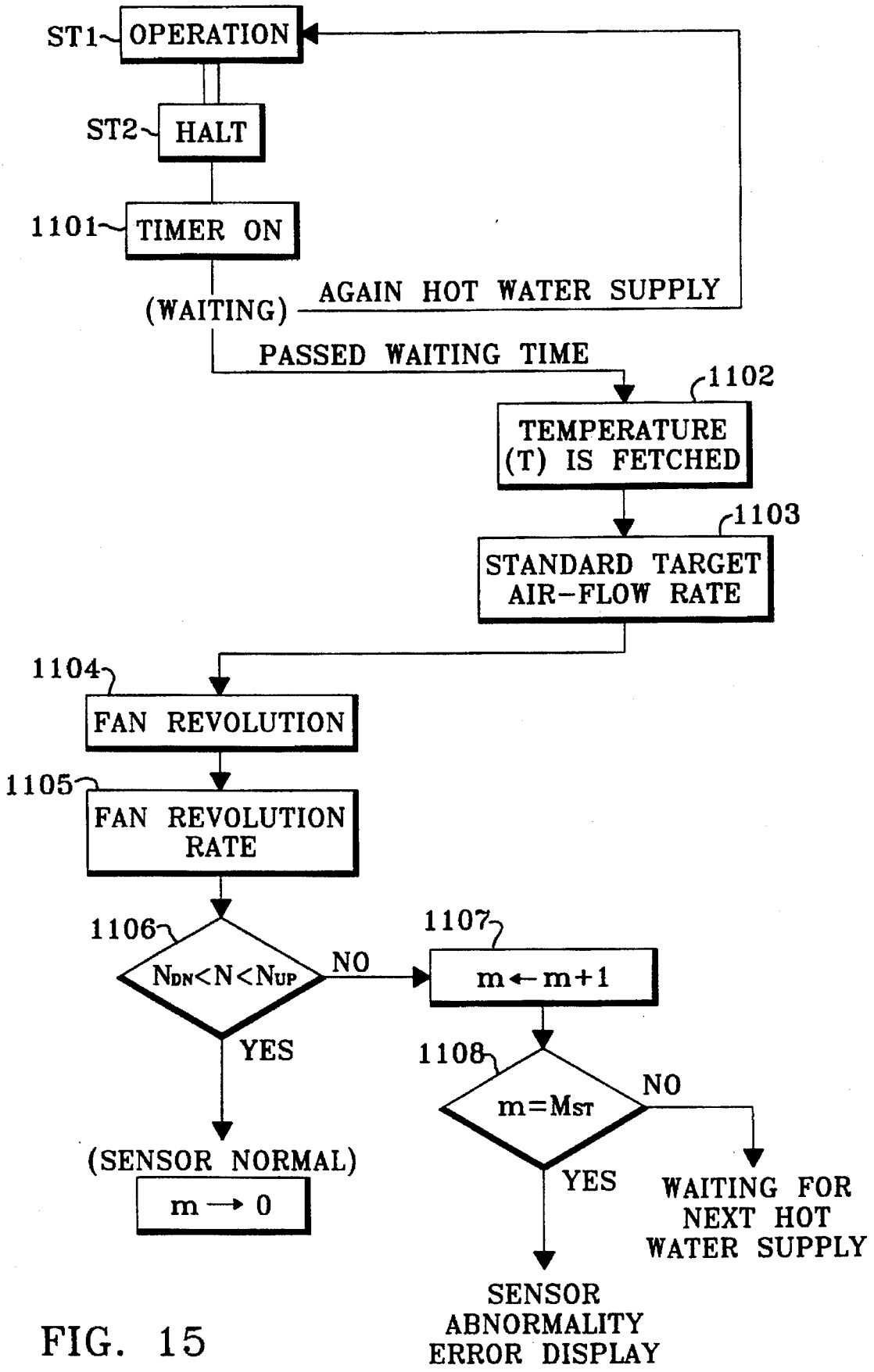
FIG. 15 is a flowchart for checking for an abnormality of an air-flow rate sensor according to the fifth embodiment of the present invention.

With the thus described arrangement, checking for an abnormality at the air-flow rate sensor 16 will now be explained while referring to the flowchart in FIG. 15. The condition at step ST1 is the operating state of the water heater. When the combustion in the water heater is halted at step ST2, the abnormality check operation for the air-flow rate sensor 16 at step 1101 and the following steps is begun.

First, at step 1101, a passed time following the halting of the combustion in the water heater is measured by a timer of the passed time measuring means 530. When, during the waiting time set by the target air-flow rate setting section 531, a hot water tap is opened to begin to supply hot water again, the program control returns to the process at step ST1, and the abnormality check for the air-flow rate sensor 16 is not performed.

When the waiting time has passed following the halting of the combustion in the water heater, at step 1102 the air temperature inside the device is fetched from the temperature sensor 29. At step 1103, a standard target air-flow rate is set to check for an abnormality at the air-flow rate sensor 16. When the standard target air-flow rate is set, at step 1104 the combustion fan 3 is revolved, and the revolution rate is controlled so that the air-flow rate detected by the air-flow rate sensor 16 matches the standard target air-flow rate.

At step 1105, after a predetermined time (e.g., nine seconds), during which the fan revolution rate becomes stable, has passed since the revolution of the combustion fan 3 was initiated, the fan revolution rate is detected by the fan revolution rate sensor 28. In this embodiment, the fan revolution rate sensor 28 is constituted by a Hall IC. The pulses emitted by the Hall IC are counted for one second, and the fan revolution rate are detected in accordance with the pulse count value. At step 1106, a check is performed to determine whether or not a detected fan revolution rate falls within the range between the upper and lower limit determination values $N_{UP}$ and $N_{DN}$, which are stored in the determination data memory 532. When the fan revolution rate falls within that range, it is determined that the air-flow rate sensor 16 is operating normally. When a count value is already held by the counter in the abnormality determination section 534, that count value is cleared.

When the detected fan revolution rate falls outside the range of the upper and lower limit determination values, it is determined that the air-flow rate sensor 16 is operating abnormally. At step 1107 the count value that is held by the counter is incremented by one. At step 1108 a check is performed to determine whether or not the count value m at the counter has reached a set standard determination count $M_{ST}$ (e.g., five). When the count value has not reached the standard determination count, the subsequent water heating operation of the water heater is placed on standby. When the count value has reached the standard determination count, it is determined that the air-flow rate sensor 16 is abnormal. A sensor abnormality signal is output and the sensor abnormality notification means 535 issues a notification that the air-flow rate sensor 16 is functioning abnormally.

According to the present invention, the revolution rate of the combustion fan is controlled so that the air-flow rate detected by the air-flow rate sensor matches a standard target air-flow rate. When the current fan revolution rate falls outside the range between the upper and lower limit determination values that is provided relative to the standard fan revolution rate for the standard target air-flow rate, it is determined that the air-flow rate sensor 16 is functioning abnormally. Not only a simple abnormality, such as the breaking of an electric wire of the air-flow rate sensor in a conventional case, but also an abnormality in the air-flow rate detection by the air-flow rate sensor 16 can be effectively determined. Thus, checking for an abnormality at the air-flow rate sensor 16 can be performed more reliably.

The standard target air-flow rate is set in accordance with an air temperature in a device that has no variance and that is uniform. The accuracy of the checking for an abnormality at the air-flow rate sensor 16 can be increased, and an abnormality at the air-flow rate sensor can be precisely detected.

As is described above, by performing maintenance on the air-flow rate sensor 16 in this embodiment, the air-flow rate sensor 16 can be employed in normal condition, and as the accuracy in the control of an air/fuel ratio is also increased, a highly reliable combustion control that provides high performance can be provided.

In this embodiment, an influence due to a variance in the internal device temperature and the ambient air temperature is avoided while checking the condition of the air-flow rate sensor 16. This is similar to the detection of the progress of ventilation degradation in the combustion device, which was previously described. However, when an abnormality at the air-flow rate sensor 16 is to be detected, a threshold value for the determination is different from a threshold value for the determination of the lifetime of the combustion device. This has also been explained in the third and fourth embodiments. In this embodiment, the threshold value for detecting an abnormality at the air-flow rate sensor 16 is set to a value that is acquired from the ratio for $CO/CO_2$ shown in FIG. 2. Therefore, a phenomenon that involves incomplete combustion and endangers the life of a user can be avoided.

The present invention is not limited to this embodiment, and various other modes can be adapted. For example, first, a standard target air-flow rate is set, and the standard fan revolution rate for the combustion fan 3 is set with respect to the standard target air-flow rate. Then, while the combustion fan 3 is so controlled that it reaches revolved the standard fan revolution rate, the output of the air-flow sensor 16 is detected. A check is performed to determine whether the output of the air-flow rate sensor 16 exceeds a predetermined upper limit value or a predetermined lower limit value. The checking for an abnormality may be performed with this process.

In this case, in FIG. 8, when the sensor output for the standard target air-flow rate is set to the value $V_m$ in advance, for example, and when the temperature that is detected by the temperature sensor 29 at this time is 20° C., point B is acquired, which is at the intersection of the vertical line for 20° C. and the air-flow rate sensor output value $V_m$. Then, the straight line for the constant fan revolution rate that passes through point B is acquired, as is indicated by the dotted line. The fan revolution rate that is represented by the straight line is defined as the standard fan revolution rate. Then, a check for an abnormality at the air-flow rate sensor 16 may be performed in the same manner.

In the above embodiment, when the abnormality determination section 534 determines that an abnormality exists at the air-flow rate sensor 16, a notification to this effect is issued by the notification means. In addition to this notification, the water heater may be locked in the combustion halted state to prevent its use until the water heater is reset after the air-flow rate sensor 16 has been repaired or it is replaced with a new one.

Further, the temperature sensor 29 can be installed in various locations in the device, as previously described. A wait time from the termination of combustion can be defined as the period that is required for a differential value of the temperature to be reduced until it is within the permissible range.

In addition, in this embodiment, when the number of abnormalities at the air-flow rate sensor 16 reaches the set standard determined count, the abnormal functioning of the air-flow rate sensor is determined. Therefore, when the determination standard count is set to two or greater, even if the fan revolution rate for acquiring a standard target air flow rate happens to fall outside the upper limit and lower limit determination range only once, this is not determined to be an abnormality immediately. Further, only when the determinations of abnormalities continue to reach the standard determination count, the abnormal functioning of the air-flow rate sensor 16 is determined. Therefore, an incorrect sensor abnormality determination, which is the result of the influence exerted by a disturbance, such as a downdraft of ambient air flowing into the flueway, will not occur, and the reliability of the sensor abnormality determination can be increased.

[Sixth Embodiment]

In the first through the fifth embodiments, self-diagnosis, such as the determination of the life being ended and the determination of an abnormality at the air-flow rate sensor, is performed several hours after the halting of combustion in order to avoid the influence due to the temperature variance in the device. However, if a user issues an instruction for the initiation of combustion several hours later, the self-diagnosis needs to be halted depending on the request of the user. In a sixth embodiment, this feature is improved.

Figure 16:
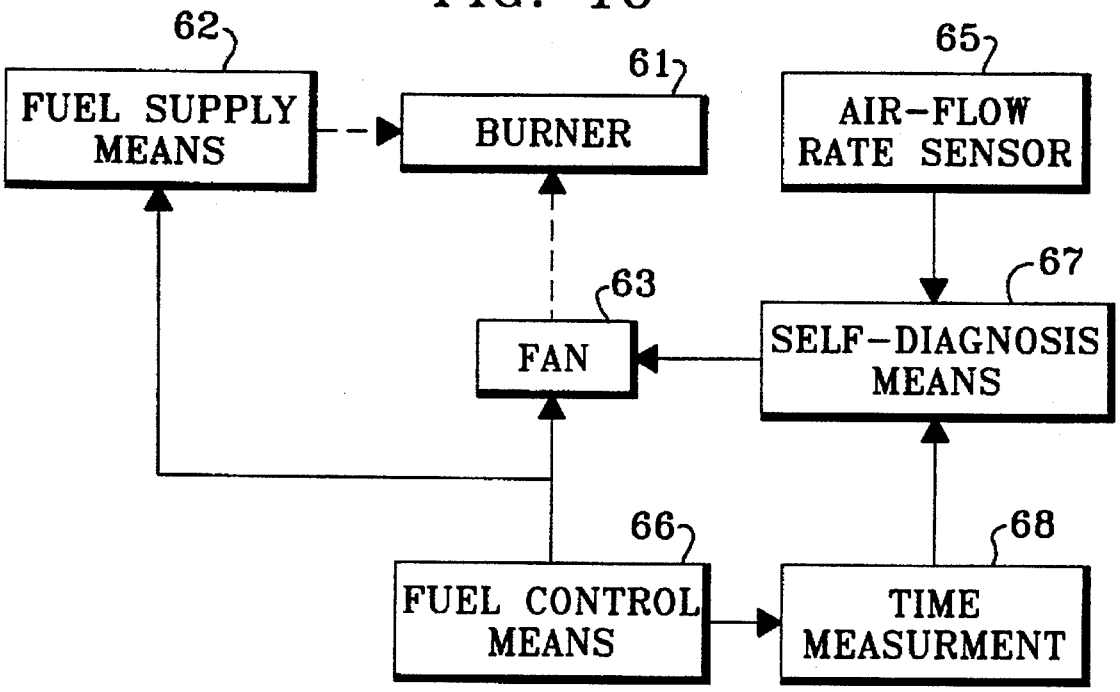
FIG. 16 is a block diagram illustrating the basic arrangement of a sixth embodiment of the present invention.

As the first feature of the sixth embodiment, as is shown in FIG. 16, a combustion device comprises: a burner 61; fuel supply means 62 for supplying fuel to the burner 61; a fan 63 for supplying combustion air to the burner 61; an air-flow rate sensor 65 for detecting an air-flow rate of the air that flows from the fan 63 to the burner 61; combustion control means 66 for controlling the fuel supply from the fuel supply means 62 and the revolution of the fan 63 so as to control the combustion at the burner 61; self-diagnosis means 67 for revolving the fan 63 and for performing a self-diagnosis for the ventilation condition based on the current revolution rate of the fan 63 and an air-flow rate detected by the air-flow sensor 65; and timer means 68 for measuring passed time following the halting of the combustion at the burner 61; wherein the self-diagnosis means 67 waits while combustion control is executed by the combustion control means 66, continues to wait until the passed time measured by the timer means 68 reaches a predetermined time, and performs a self-diagnosis when the passed time reaches the predetermined time, and further halts the self-diagnosis performance when combustion is initiated by the combustion control means 66 during the self-diagnosis.

In this embodiment, self-diagnosis is performed after a predetermined time following the termination of combustion. Therefore, the self-diagnosis performance is not affected by the temperature of the components of the combustion device, and the relationship between the fan revolution rate and the detected air-flow rate depends only on the ventilation condition. As a result, the ventilation condition can be accurately diagnosed. It is important that the combustion control be performed prior to the performance of the self-diagnosis, and the device can immediately respond to a request for the initiation of combustion even during the self-diagnosis.

As the second feature of the sixth embodiment, a combustion device comprises: a first combustion section for supplying hot water, including a first burner and first fuel supply means; a second combustion section having a second burner and second fuel supply means; a common fan for driving combustion air to both first and second burners; an air-flow rate sensor for detecting the air-flow rate of the air flowing to the second combustion section from the fan; a first combustion control means for controlling the combustion at the first burner through controlling the fuel supply from the first fuel supply means, and the revolution of the fan; a second combustion control means for controlling the combustion at the second burner through controlling the fuel supply from the second fuel supply means, and the revolution of the fan; self-diagnosis means for revolving the fan and for performing a self-diagnosis for the ventilation condition at the first and the second combustion sections based on a current fan revolution rate and an air-flow rate detected by an air-flow rate sensor; and timer means for measuring passed time following the halting of combustion at one of the burners, at which combustion is last performed; wherein the self-diagnosis means waits while combustion control is executed by one of the first and the second combustion control means, continues to wait until the passed time is measured by the timer means reaches a predetermined time, and performs a self-diagnosis when the passed time reaches the predetermined time, and further the self-diagnosis means halts the self-diagnosis when combustion for supplying hot water is initiated by the first combustion control means, and inhibits combustion by the second combustion control means to force the second combustion control means to wait until the self-diagnosis has been completed even when the initiation of combustion at the second combustion section is requested during the self-diagnosis.

In this embodiment, combustion air is supplied by the fan commonly used for the first and the second combustion sections. The self-diagnosis is performed after a predetermined time passed after the halting of the combustion at one of the burners, at which combustion is last performed. Therefore, the air flow rate is not affected by the temperatures of the components of the first and the second combustion sections even through the common fan is employed. As a result, the ventilation condition in the first and the second combustion sections can be accurately diagnosed based on the fan revolution rate and the detected air-flow rate. Since the combustion control by the first combustion section has a higher priority than the self-diagnosis, the device can quickly respond to a request to begin supplying hot water, and an inconvenience for a user, such as the supply of hot water being delayed or only cold water flowing out, can be avoided. Further, since the initiation of combustion at the second combustion section is inhibited during the self-diagnosis, a drastic reduction in opportunities to perform the self-diagnosis can be prevented.

The sixth embodiment will now be described while referring to FIGS. 17 through 21. The combustion device shown in FIG. 21 includes a water heater (first combustion section) 610 and a bath water heater (second combustion section) 620. The water heater 610 includes a burner 611 and a heat exchanger 612. The burner 611 has three burner portions 611*a*, 611*b* and 611*c* in a casing 613. The bath water heater 620 also has a burner 621 and a heat exchanger 622. In addition, the combustion device has a fan 630 that communicates with the casings 613 and 623 of the water heater 610 and the bath water heater 620 and that is used in common to drive combustion air to the burners 611 and 621. A revolution rate sensor 631, such as a Hall IC, for measuring the revolution rate of the fan is attached to the fan 630.

An air-flow rate sensor 635 is provided in the water heater 610 to detect the air-flow rate from the fan 630 to the burner 611 in the water heater 610. The air-flow rate sensor 635 is located along the route of a bypass 636 that connects the upstream portion of the burner 621 to the downstream portion thereof. The air-flow rate sensor 635 is constituted by an flow rate sensor of a hot wire type or a Karman vortex type, or a differential pressure sensor.

The combustion device has a gas supply pipe 640. The gas supply pipe 640 includes an original pipe portion 641 and branched pipe portions 642 and 643 that extend from the original pipe portion 641. A primary solenoid switching valve 645 and a solenoid proportioning pressure control valve (proportioning valve) 646 are provided along the original pipe portion 641. Along the branched pipe portion 642, three solenoid switching valves 647*a*, 647*b* and 647*c* are provided that correspond to the burner portions 611*a*, 611*b* and 611*c* of the water heater 610. The supply of gas to the burner portions 611*a*, 611*b* and 611*c* is selectively controlled by the solenoid switching valves 647*a*, 647*b* and 647*c*. The maximum combustion output at the burner 611 is performed when the solenoid proportioning pressure control valve 646 is fully opened. Further, the supply of gas to the burner 621 of the bath water heater 620 is controlled by the corresponding solenoid switching valve 648. The gas supply pipe 640 and the valves 645, 646, 647*a*, 647*b*, 647*c* and 648 constitute gas supply means (fuel supply mens) for the water heater 610 and the bath water heater 620.

A water supply pipe 615 for hot water passes through the heat exchanger 612 in the water heater 610. A temperature sensor 616*a* and a water volume sensor 617 are provided upstream in the water supply pipe 615, i.e., the water inlet side. A temperature sensor 616*b*, a water-flow sensor 618, a water-flow control valve 619 are provided downstream in the water supply pipe 615, i.e., the hot water outlet side. A hot water tap (not shown) is located at the distal end of the pipe 615.

A circulating water supply pipe 625 passes through the heat exchanger 622 of the bath water heater 620. Both ends of the water supply pipe 625 are connected to a circulation device (not shown) that is installed in a bathtub (not shown). A pump 626 is positioned at the water supply pipe 625 along which a water-flow sensor 627 and a temperature sensor 628 are provided.

The combustion device has an auxiliary pipe 650 for supplying hot water to a bathtub and for adding hot water therein. The auxiliary water supply pipe 650 connects the downstream portion of the water supply pipe 615 for the water heater 610 to the water supply pipe 625 of the bath water heater 620. A solenoid switching valve 655 and a pressure sensor 656 are provided on route.

The combustion device also includes a microcomputer 660. The microcomputer 660 receives detection signals from the water-flow rate sensor 617, the water-flow sensors 618 and 627, the temperature sensors 616*a*, 616*b* and 628, the air-flow rate sensor 635, and the pressure sensor 656; and command signals from a remote controller (not shown). In accordance with these received signals, the microcomputer 60 controls the valves 619, 645, 646, 647*a*, 647*b*, 647*c*, 648 and 655, the fan 630, and the pump 626.

The microcomputer 660 substantially comprises water heater combustion control means (first combustion control means), bath water heater combustion control means (second combustion control means), and self-diagnosis means.

The water heater combustion control means ignites the burner 611 and controls the water-flow control valve 619 to adjust the hot water volume, based on information received from the temperature sensor 616*a* concerning the incoming water temperature, and from the temperature sensor 616*b* concerning the hot water temperature, and a set temperature from the remote controller. Also based on such information, the water heater combustion control means controls the valves 645, 646, 647*a*, 647*b* and 647*c* to adjust the volume of the gas that is supplied to the burner 611. Further, the revolution rate of the fan 630 is controlled so that the air-flow rate detected by the air-flow rate sensor 635 matches the supplying gas volume. For supplying hot water into a bathtub or for adding hot water therein, the solenoid valve 655 is opened.

The bath water heater combustion control means ignites the burner 621, and opens the valves 645, 646, and 648 to supply gas. Then, the fan 630 is revolved, the pump 626 is driven to circulate the hot water in the bathtub, and the temperature of the hot water in the bathtub is increased. When the bath water heating is independently performed without employing the water heating control, the degree to which the proportioning pressure control valve 646 is opened is determined based on the maximum combustion capacity of the burner 621. The fan revolution rate is decided in accordance with the maximum combustion capacity. When the bath water heating is performed in parallel to the supplying of hot water, the degree to which the proportioning pressure control valve 646 is opened and the fan revolution rate are decided based on the above described water heating control.

When the fan 630 is revolved at a predetermined revolution rate and the air-flow rate to the water heater 610 is detected by the air-flow rate sensor 635, the self-diagnosis means employs the relationship between the fan revolution rate and the detected air-flow rate to determine the ventilation condition, including the dust blockage condition, of the heat exchangers 612 and 622. The air-flow rate is corrected in accordance with the ambient air temperature. The ambient air temperature information is acquired from a temperature sensor (not shown) that is located near the gas nozzle, for example. The ventilation condition may be determined without using the ambient air temperature information, but by employing the air-flow rate at an average ambient air temperature, e.g., 25° C.

The priority order for the water heating control, the bath water heating control, and the self-diagnosis will now be explained.

The water heating combustion has the highest priority. More specifically, when the initiation of water heating is requested while bath water is being heated, the water heating control is immediately started while the bath water heating is continued. When the water heating is requested during self-diagnosis, the self-diagnosis is halted and the water heating control is immediately started. Since, in this manner, the water heating has the highest priority and is immediately initiated upon a request for the initiation of water heating, the supply of hot water will not be delayed and the supplying of cold water is prevented.

Self-diagnosis waits while at least one of the water heating and the bathtub water heating processes are performed. Self-diagnosis continues to wait until a passed time following the halting of combustion (that is measured by the timer means) reaches a predetermined time. Thus, at the time of the self-diagnosis, the temperatures at the burner 611 and the heat exchanger 612 of the water heater 610, the burner 621 and the heat exchanger 622 of the bath water heater 620, and the other individual components, such as the flueway, are almost equal to the ambient air temperature, and there are no temperature differences among these components. Thus, the transmitted air-flow volume is not affected by temperature differences among components, and the relationship between the fan revolution rate and the detected air-flow rate depends only on the ambient air temperature and the ventilation condition. As a result, the ventilation condition can be accurately diagnosed based on the ambient air temperature, the fan revolution rate, and the detected air-flow rate.

When the common fan 630 is employed, the air-flow volume at the water heater 610 is affected by the temperatures of the components of the bath water heater 620. However, since self-diagnosis is performed when there is no effect due to temperature differences between the components of the bath water heater 620 and the water heater 610, the diagnosis of the ventilation condition is reliable.

The bath water heating is inhibited during self-diagnosis. That is, even if the initiation of bath water heating is requested during self-diagnosis, self-diagnosis is not halted but is continued until it is completed. The bath water heating is employed to increase the temperature of the hot water in the bathtub, and has low priority compared with the water heating. No inconvenience will be incurred even though the bath water heating is on standby during self-diagnosis. In this manner, the opportunities for the performance of self-diagnosis can be prevented from being reduced.

The control routine that is performed by the microcomputer 660 will now be described while referring to FIGS. 17 through 20. An interrupt routine in FIG. 17 for water heating control will be explained first. This interrupt routine is also begun when the hot water tap is opened and the water volume sensor 617 detects the water flow. Further, the control routine also starts when the solenoid switching valve 655 is opened in response to the request for adding hot water to bathtub. The start of the routine corresponds to a request for water heating. When the set temperature for the bath is lowered by the remote controller, merely the solenoid switching valve 655 is opened and water is supplied through the pipe 615 to the auxiliary pipe 650 and the pipe 625 to the bathtub, and the water heating routine in FIG. 17 is not performed.

Figure 17:
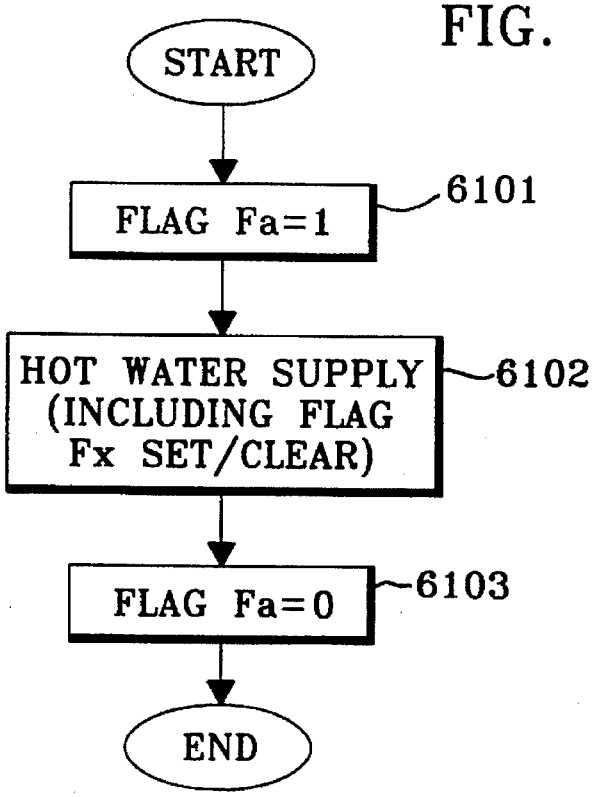
FIG. 17 is a flowchart for a hot water supply routine that is executed by a microcomputer.

When the interrupt routine in FIG. 17 is started, first, a flag Fa is set (step 6101). The flag Fa indicates that the combustion control at the water heater 610 is being performed. Then, the water heating, including combustion at the water heater 610, is performed (step 6102).

When, at step 6102, the burner 611 is ignited, or when one of the solenoid valves 647*a*, 647*b*, and 648*c* is newly opened, a flag Fx is set. When a predetermined time has passed following the ignition or capacity switching, the flag Fx is cleared. The flag Fx indicates that the combustion at the burner 611 of the water heater 610 is unstable. When the water-flow rate sensor 617 detects the halting of the water supply when the hot water tap is closed (when the water level in the bathtub that is detected by the pressure sensor 628 reaches a set water level in case of supplying or adding hot water to the bathtub), the flag Fa is cleared (step 6103). The routine is then terminated.

Figure 18:
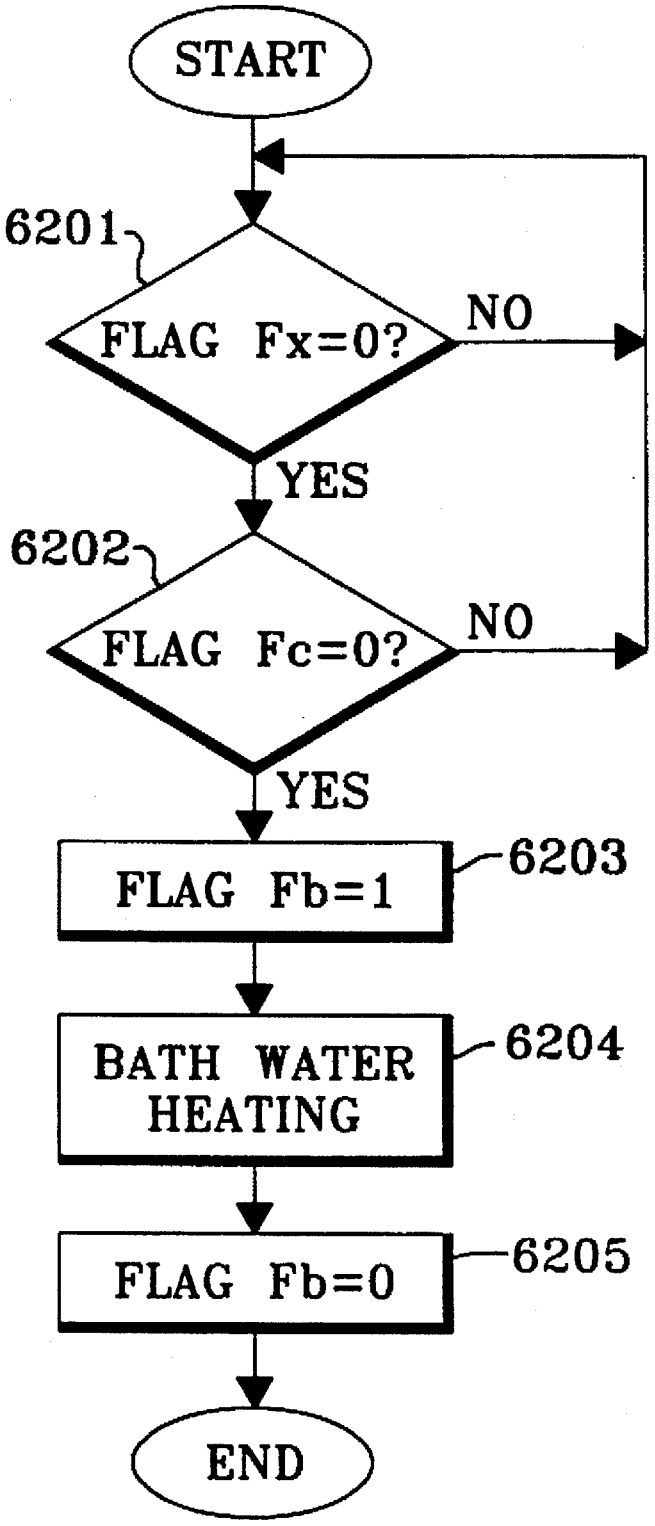
FIG. 18 is a flowchart for a bath water heating routine that is executed by the microcomputer.
Figure 19:
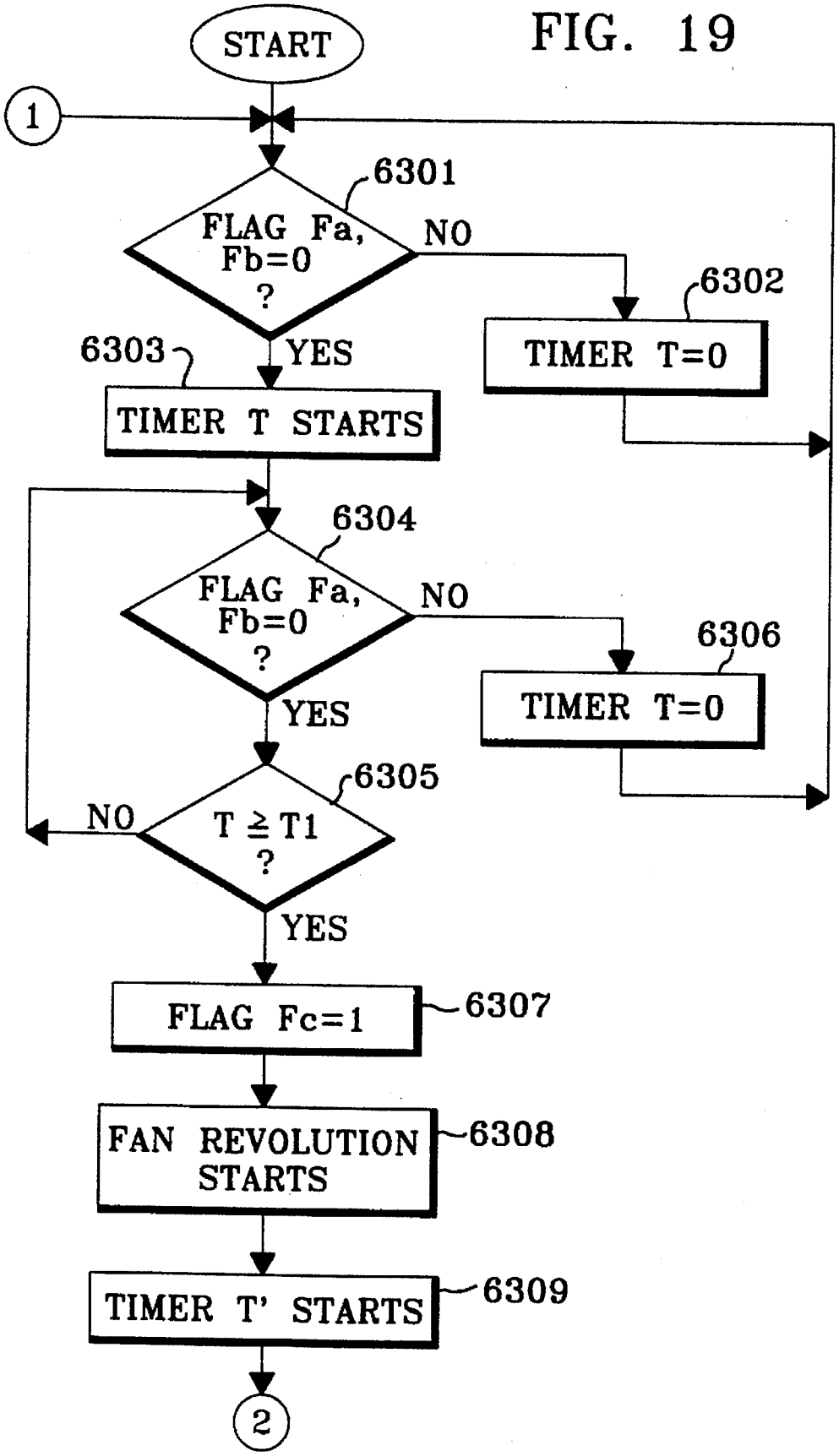
FIG. 19 is a flowchart for the first part of a self-diagnosis routine that is executed by the microcomputer.

The interrupt routine for bath water heating in FIG. 18 will now be described. When the pump 626 is driven at predetermined intervals to circulate hot water in the bathtub, and the hot water temperature detected by the temperature sensor 628 is lower than a set temperature, the interrupt routine is initiated. First, a check is performed to determine whether or not the flag Fx that indicates the combustion at the water heater 610 is instable is cleared (step 6201). When the decision is negative, i.e., when the combustion at the water heater 610 is instable, the program control waits until the flag Fx is cleared.

When the decision at 6201 is affirmative, i.e., when the combustion at the water heater 610 is stable, program control moves to step 6202. A check is then performed to determine whether or not the flag Fc is cleared. The flag Fc indicates that self-diagnosis, which will be described later, is being performed. When the decision is negative, i.e., when self-diagnosis is being performed, program control waits until the flag Fc is cleared.

When the decision at step 6202 is affirmative, i.e., when self-diagnosis is not being performed or when self-diagnosis has been terminated, program control moves to step 6203, whereat the flag Fb is set. The flag Fb indicates that the bath water heating is being controlled. Program control then advances to step 6204, whereat the bath water heating is performed.

When the temperature of the hot water that is detected by the temperature sensor 628 reaches the set temperature, program control moves to step 6205 whereat the flag Fb is cleared. This routine is thereafter terminated.

The self-diagnosis routine will now be explained. This routine is begun by turning on a power switch for a control unit that includes a microcomputer. At step 6301 in FIG. 19, a check is performed to determine whether both flags Fa and Fb are cleared. When the decision is negative, i.e., when water heating is being performed or when bath water heating is being performed, timer T (timer means) is cleared (step 6302), and program control returns to step 6301. The procedures at steps 6301 and 6302 are repeated until the flags Fa and Fb are cleared (self-diagnosis waiting).

When both flags Fa and Fb are cleared, i.e., when the combustion at one of the burners 611 and 612 that was last in the combustion state is halted, the decision at step 6301 is affirmative, and program control advances to step 6303. The timer T is then started. A check is again performed to determine whether or not the flags Fa and Fb are cleared (step 6304). When the decision is affirmative, a check is then performed to determine whether or not a passed time following the halting of combustion, which is measured by the timer T, has reached a predetermined time T1 (e.g., four hours) (step 6305). When the decision is negative, program control returns to step 6304. In this manner, program control waits until four hours has passed following the halting of the last combustion (self-diagnosis waiting). When combustion is initiated either at the water heater 610 or the bath water heater 620 before four hours have passed, the decision at step 6304 is negative. Program control advances to step 6306 whereat the timer T is cleared and program control thereafter returns to step 6301.

When four hours have passed following the halting of the last combustion, the decision at step 6305 is affirmative, and the following self-diagnosis is performed. In other words, the flag Fc is set (step 6307), the revolution of the fan 630 is begun (step 6308), and the timer T' is started (step 6309). The timer T' measures the time that passes following the beginning of the self-diagnosis mode, i.e., the start of the revolution of the fan 630.

Figure 20:
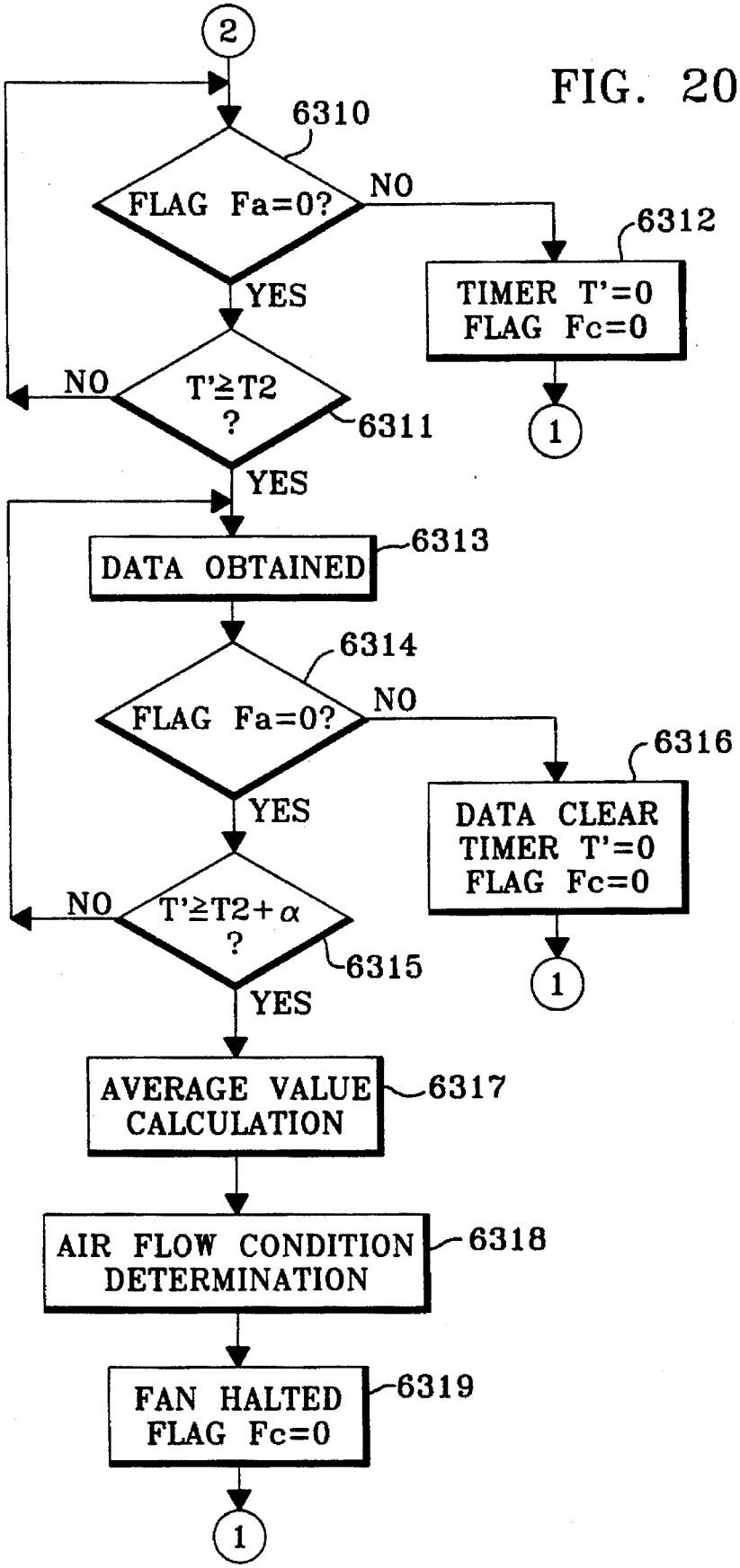
FIG. 20 is a flowchart for the second part of a self-diagnosis routine that is executed by the microcomputer.
Figure 21:
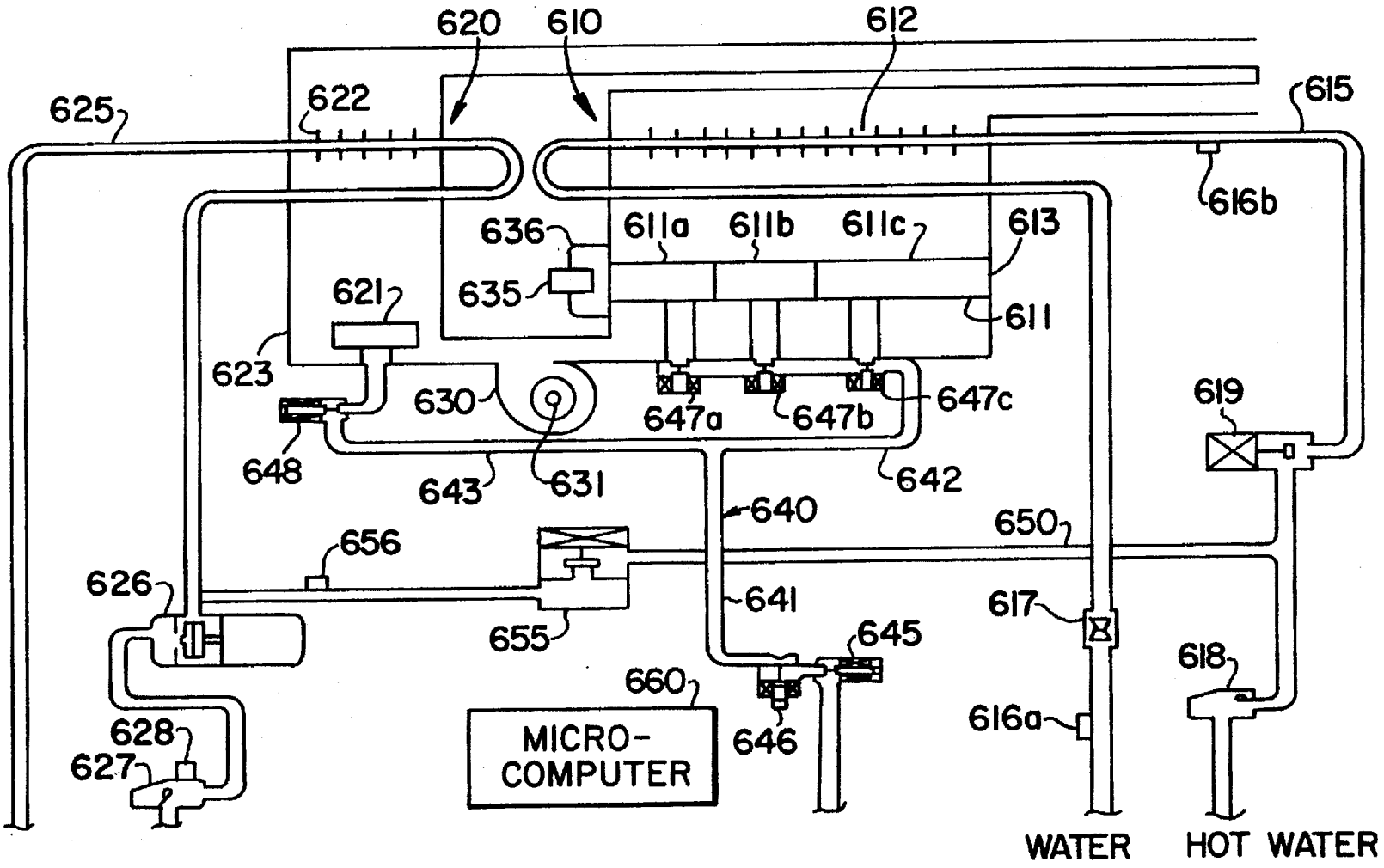
FIG. 21 is a schematic diagram showing the entire structure of the sixth embodiment.

At step 6310 in FIG. 20, a check is performed to determine whether or not the flag Fa is cleared. When the decision is affirmative, a check is performed to determine whether or not the time passed following the start of the revolution of the fan that is measured by the timer T' has reached a predetermined time T2 (e.g., eight seconds) (step 6311). When the decision is negative, program control returns to step 6310. In this manner, program control waits until eight seconds have passed following the start of the revolution of the fan. This means the process waits until the revolution of the fan reaches a predetermined revolution rate following the start of the revolution. When combustion is initiated at the water heater 610 before eight seconds have passed, the decision at step 6310 is negative. Program control advances to step 6312, whereat the timer T' is cleared and the flag Fc is cleared. Program control then returns to step 6301. As is described above, when combustion is initiated at the water heater 610, self-diagnosis is terminated. But if the initiation of bath water heating is requested for the bath water heater 620 during self-diagnosis, the self-diagnosis process is continued. During this time, the bath water heating is inhibited and is placed in the waiting state (see step 6202 in FIG. 18).

When eight seconds have passed following the start of the fan revolution, the decision at 6311 is affirmative and program control advances to step 6313, whereat the data detected by the air-flow rate sensor 635 is fetched. Then, a check is performed to determine whether or not the flag Fa is cleared. When the decision is affirmative, program control advances to step 6315. A check is performed to determine whether or not the time passed following the start of the fan revolution that is measured by the timer T' has reached a predetermined time T2+α (e.g., 8.8 seconds). When the decision is negative, program control again returns to step 6313, and the data detected by the air-flow rate sensor 635 is fetched. The fetching of the detected data is performed every 0.1 second, eight times in total. When water heating is initiated during the execution of the loop for fetching the detected data (loop of steps 6313, 6314 and 6315), the decision at step 6314 is negative. Program control advances to step 6316 whereat the detected data is cleared, the timer T' is cleared, and the flag Fc is cleared. Program control thereafter returns to step 6301. When combustion is initiated at the water heater 610, the fetching of data for self-diagnosis is halted. When bath water heating is requested for the bath water heater 30 while data are being fetched, data fetching is continued. During this period, the bath water heating is inhibited and is in the waiting state (see step 6202 in FIG. 18).

When the fetching of data has been performed eight times, the decision at 6315 is affirmative. Program control advances to step 6317, whereat the average value for air-flow rate data is calculated. At step 6318, a check is performed to determine whether or not the average value is suitable for a predetermined fan revolution rate. When dust blockage occurs at the heat exchanger 612, the average air-flow rate is lower than a value that is suitable for the predetermined revolution rate. When the average air-flow rate value exceeds a value that is suitable for the predetermined revolution rate, a warning is displayed. When the average value falls outside a lower predetermined range, a combustion inhibit flag is set, and the subsequent combustion at the water heater 610 and the bath water heater 620 is inhibited.

Then, at step 6319, the revolution of the fan 630 is halted, the flag Fc is cleared, and program control returns to step 6301.

The present invention is not limited to the above embodiments and various other modes can be applied. For example, the fuel is not limited to gas and may be petroleum (kerosene, gas oil, motor fuel), etc. When petroleum is used, it is supplied by an electromagnetic pump. As the second combustion section, a space heating combustion section may be employed instead of a bath water heater.

As is described above, according to the embodiments, the ventilation condition can be accurately diagnosed without any influence due to the temperatures of the components in the combustion device. Further, since the combustion control has a higher priority than self-diagnosis, the device can immediately respond to a request for the initiation of combustion.

In addition, according to the embodiments, even through the fan is used commonly, the air-flow rate is neither affected by the temperatures of the components of the first combustion section nor by the temperatures of the components of the second combustion section, and the ventilation condition can be accurately diagnosed. Since the combustion control at the first combustion section has a higher priority than self-diagnosis, the device can quickly respond to a request for the initiation of water heating. Inconveniences such as the supply of hot water being delayed or cold water flowing from a faucet can be prevented. Since the initiation of combustion at the second combustion section is inhibited during self-diagnosis, a drastic reduction in the opportunities for the performance of self-diagnosis can be prevented.

What we claim are:

1. A combustion device having a burner, a combustion fan for ventilating the burner, a revolution rate detection device for detecting a revolution rate of the combustion fan, and an air-flow rate sensor for detecting an air-flow rate of air flowing from an air-inlet to an exhaust port for the burner, said combustion device further comprising:

a temperature sensor for detecting a temperature of the inside or the peripheral of the combustion device; and control means for determining whether the revolution rate detected by the revolution rate detection device is within a predetermined range of permissible revolution rates while the revolution of the combustion fan is so controlled that the air-flow rate detected by the air-flow rate sensor stays at a predetermined standard air-flow rate during no combustion;

wherein the control means correct the standard air-flow rate or the permissible revolution rate according to the temperature characteristics thereof based on the temperature detected by the temperature sensor.

2. A combustion device having a burner, a combustion fan for ventilating the burner, a revolution rate detection device for detecting a revolution rate of the combustion fan, and an air-flow rate sensor for detecting an air-flow rate of air flowing from an air-inlet to an exhaust port for the burner, said combustion device further comprising:

a temperature sensor for detecting a temperature of the inside or the peripheral of the combustion device; and control means for determining whether the air-flow rate detected by the air-flow rate sensor is within a predetermined range of permissible air-flow rate while the revolution of the combustion fan is so controlled that the revolution rate detected by the revolution detection device stays at a predetermined standard revolution rate during no combustion;

wherein the control means correct the standard revolution rates or the permissible air-flow rate according to the temperature characteristics thereof based on the temperature detected by the temperature sensor.

3. A combustion device of claim 1, wherein;

said control means make the determination after a predetermined time has passed since a combustion of the burner halts.

4. A combustion device of claim 3, wherein;

the predetermined time is a time until when a temperature variance in the combustion device falls within a predetermined range.

5. A combustion device of claim 1, 3 or 4, wherein;

the permissible revolution rate includes a first permissible revolution rate and a second permissible revolution rate smaller than the first permissible revolution rate, and the control means determine an abnormality or life ended of the combustion device when the detected revolution rate is over the second permissible revolution rate.

6. A combustion device of claim 5, wherein; the control means determine a malfunction of the air-flow sensor when the detected revolution rate is over the first permissible revolution rate.

7. A combustion device of claim 5, wherein;

the control means determine the abnormality or the life ended of the combustion device when the detected revolution rate is over the second permissible revolution rate but not over the first permissible revolution rate.

8. A combustion device of claim 5, wherein;

the control means first decrease the fuel supply to the burner when the detected revolution rate is over the second permissible revolution rate, then determine the abnormality or the life ended of the combustion device when the further detected revolution rate is over the second permissible revolution rate thereafter.

9. A combustion device of claim 1, 3 or 4, wherein;

the control means determine whether the average of plural detected revolution rate values is over the permissible revolution rate.

10. A combustion device of claim 6, wherein;

the control means determine the malfunction of the air-flow sensor when the detected revolution rate is over the first permissible revolution rate plural times.

11. A combustion device of claim 2, wherein; said control means make the determination after a predetermined time has passed since a combustion of the burner halts.

12. A combustion device of claim 11, wherein;

the predetermined time is a time until when a temperature variance in the combustion device falls within a predetermined range.

13. A combustion device of claim 2, 11 or 12, wherein;

the permissible air-flow rate includes a first permissible air-flow rate and a second permissible air-flow rate larger than the first permissible air-flow rate, and the control means determine an abnormality or life ended of the combustion device when the detected air-flow rate is lower than the second permissible air-flow rate.

14. A combustion device of claim 13, wherein;

the control means determine a malfunction of the air-flow sensor when the detected air-flow rate is lower than the first permissible air-flow rate.

15. A combustion device of claim 13, wherein;

the control means determine the abnormality or the life ended of the combustion device when the detected air-flow rate is lower than the second permissible air-flow rate but not lower the first permissible air-flow rate.

16. A combustion device of claim 13, wherein;

the control means first decrease the fuel supply to the burner when the detected air-flow rate is lower than the second permissible air-flow rate, then determine the abnormality or the life ended of the combustion device when the further detected air-flow rate is lower than the second permissible air-flow rate thereafter.

17. A combustion device of claim 2, 11 or 12, wherein;

the control means determine whether the average of plural detected air-flow rate values is lower than the permissible air-flow rate.

18. A combustion device of claim 14, wherein;

the control means determine the malfunction of the air-flow sensor when the detected air-flow rate is lower than the first permissible air-flow rate plural times.

19. A combustion device comprises:

a burner;

fuel supply means for supplying fuel to the burner;

a combustion fan for supplying combustion air to the burner;

an air-flow rate sensor for detecting air-flow rate of the air supplied by the combustion fan to the burner;

combustion control means for controlling the fuel supply from the fuel supply means and the revolution of the fan so as to control the combustion at the burner;

self-diagnosis means for performing a self-diagnosis for the ventilation condition, through revolving the fan, based on the revolution rate of the fan and the air-flow rate detected by the air-flow sensor; and timer means for measuring passed time following the halting of the combustion at the burner;

wherein the self-diagnosis means wait while combustion control is executed by the combustion control means, continue to wait until the passed time measured by the timer means reaches a predetermined time, and perform the self-diagnosis when the passed time reaches the predetermined time, and further the self-diagnosis means halts the self-diagnosis performance when combustion is initiated by the combustion control means during the self-diagnosis.

20. A combustion device comprises:

a first combustion section for supplying hot water, having a first burner and first fuel supply means;

a second combustion section having a second burner and second fuel supply means;

a common fan for supplying combustion air to the both first and second burners;

an air-flow rate sensor for detecting the air-flow rate of the air supplied by the fan to the second combustion section;

a first combustion control means for controlling the combustion at the first burner through controlling the fuel supply from the first fuel supply means, and the revolution of the fan;

a second combustion control means for controlling the combustion at the second burner through controlling the fuel supply from the second fuel supply means, and the revolution of the fan;

self-diagnosis means for performing a self-diagnosis of the ventilation condition at the first and second combustion sections, through revolving the fan, based on a revolution rate and the air-flow rate detected by the air-flow rate sensor; and timer means for measuring passed time following the halting of a combustion at one of the burners, at which combustion is last performed;

wherein the self-diagnosis means wait while combustion control is executed by one of the first and second combustion control means, continue to wait until the passed time measured by the timer means reaches a predetermined time, and perform the self-diagnosis when the passed time reaches the predetermined time, and further the self-diagnosis means halt the self-diagnosis when combustion for supplying hot water is initiated by the first combustion control means, and inhibit combustion by the second combustion control means to force the second combustion control means to wait until the self-diagnosis has been completed even when the initiation of combustion at the second combustion section is requested during the self-diagnosis.

21. A combustion device comprises:

a burner;

fuel supply means for supplying fuel to the burner;

a combustion fan supplying air for combustion to the burner;

revolution rate detection means for detecting a revolution rate of the combustion fan;

an air-flow rate sensor for detecting an air-flow rate of the air supplied to the burner;

combustion control means for controlling the fuel supplied by the fuel supplying means and the revolution rate of the combustion fan so as to control the combustion at the burner;

a temperature sensor for detecting a temperature at the combustion device; and diagnosis means for performing a self-diagnosis to determine a ventilation condition based on a relationship between the revolution rate of the combustion fan detected by the revolution rate detection means and the air-flow rate detected by the air-flow rate sensor, said diagnostic means correcting the detected revolution rate or the air-flow rate based on the temperature detected by the temperature sensor in the process of performing the self-diagnosis.

22. A combustion device of claim 21, said diagnosis means perform the self-diagnosis after a predetermined time has passed since a combustion halts.

23. A combustion device of claim 21 or 22, said diagnosis means store a first permissible range corresponding to a first air-flow blockage condition relative to a normal ventilation condition and a second permissible range corresponding to a second air-flow blockage condition better than the first air-flow blockage condition, and determine abnormality of the combustion device when the detected relationship of the revolution rate and the air-flow rate is outside from the first permissible range.

24. A combustion device of claim 23, said diagnosis means determine the ventilation condition to be deteriorated when the detected relationship of the revolution rate and the air-flow rate is in the first permissible range but outside from the second permissible range.

25. A combustion device of claim 24, said diagnosis means first decrease the fuel supply to the burner when the ventilation condition is determined to be deteriorated, then determine the abnormality or the life ended of the combustion device when further the ventilation condition is determined to be deteriorated thereafter.

26. A combustion device of claim 21, wherein;

said diagnosis means obtain the relationship between the revolution rate and the air-flow rate for the self-diagnosis performance based on a initial relationship therebetween which is initially detected under an environment for installing the combustion device.

* * * * *

UNITED STATES PATENT AND TRADEMARK OFFICE

CERTIFICATE OF CORRECTION

PATENT NO. : 5,658,140
DATED : August 19, 1997
INVENTOR(S) : Kondou et al.

It is certified that error appears in the above-identified patent and that said Letters Patent is hereby corrected as shown below:

Column 2, line 11, delete "change in" and insert --changes in-- therefor

Column 10, line 4, delete "signal." and insert --signal-- therefor

Column 12, line 14, delete "a the" and insert --a-- therefor

Column 12, line 15, delete "same" and insert --the same-- therefor

Column 12, line 35, delete "airsflow" and insert --air- flow-- therefor

UNITED STATES PATENT AND TRADEMARK OFFICE

CERTIFICATE OF CORRECTION

PATENT NO. : 5,658,140
DATED : August 19, 1997
INVENTOR(S) : Kondou et al.

It is certified that error appears in the above-identified patent and that said Letters Patent is hereby corrected as shown below:

Column 12, line 42, delete "of" and insert --of a-- therefor

Column 14, line 6, delete "revolution Signal" and insert --revolution signal-- therefor Column 25, line 35, delete "values." and insert --values-- therefor Column 25, line 45, delete "$CO/C0_2$" and insert --$CO/CO_2$-- therefor

UNITED STATES PATENT AND TRADEMARK OFFICE

CERTIFICATE OF CORRECTION

PATENT NO. : 5,658,140
DATED : August 19, 1997
INVENTOR(S) : Kondou et al.

It is certified that error appears in the above-identified patent and that said Letters Patent is hereby corrected as shown below:

Column 36, line 31, delete "or life" and insert --or a life-- therefor

Column 37, line 4, delete "or life" and insert

--or a life-- therefor

Column 38, line 10, delete "the ventilation"

and insert -- a ventilation-- therefor

Signed and Sealed this

Twenty-ninth Day of September, 1998

*Attest:*

Bruce Lehman

BRUCE LEHMAN

*Attesting Officer*

*Commissioner of Patents and Trademarks*